US011514748B2

(12) United States Patent
Amaitis et al.

(10) Patent No.: US 11,514,748 B2
(45) Date of Patent: Nov. 29, 2022

(54) SYSTEM AND METHOD FOR CONVENIENCE GAMING

(71) Applicant: INTERACTIVE GAMES LLC, New York, NY (US)

(72) Inventors: Lee M. Amaitis, New Yok, NY (US); Joseph M. Asher, Las Vegas, NV (US); Howard W. Lutnick, New York, NY (US); Darrin M. Mylet, Tampa, FL (US); Alan B. Wilkins, Raleigh, NC (US)

(73) Assignee: INTERACTIVE GAMES LLC, New York, NY (US)

( * ) Notice: Subject to any disclaimer, the term of this patent is extended or adjusted under 35 U.S.C. 154(b) by 91 days.

(21) Appl. No.: 16/939,622

(22) Filed: Jul. 27, 2020

(65) Prior Publication Data

US 2020/0357226 A1 Nov. 12, 2020

Related U.S. Application Data

(63) Continuation of application No. 13/561,303, filed on Jul. 30, 2012, now Pat. No. 10,726,664, which is a (Continued)

(51) Int. Cl.
*G07F 17/32* (2006.01)

(52) U.S. Cl.
CPC ..... *G07F 17/3223* (2013.01); *G07F 17/32* (2013.01); *G07F 17/3241* (2013.01)

(58) Field of Classification Search
CPC ... G07F 17/3223; G07F 17/32; G07F 17/3241
(Continued)

(56) References Cited

U.S. PATENT DOCUMENTS 3,580,581 A 5/1971 Raven
3,838,259 A 9/1974 Kortenhaus
(Continued)

FOREIGN PATENT DOCUMENTS

CN 1346549 4/2002
DE 31 29 550 A1 4/1982
(Continued)

OTHER PUBLICATIONS

Solutions for Restaurants, Hotels & Resorts and Clubs—Guest bridge, Inc. (online). Guestbridge, Inc. Feb. 6, 2007 [retrieved on Aug. 21, 2008]. Retrieved from the Internet: <URL: http://web.archive.org/web/20070206134139/www.guestbridge.com/solutions.html, entire document especially p. 1.
(Continued)

*Primary Examiner* — Jay Trent Liddle
*Assistant Examiner* — Ryan Hsu

(57) ABSTRACT

A convenience gaming system is provided. The convenience gaming system allows users to access applications via gaming communication devices coupled to a communication network. At least a portion of the network may be wireless. The gaming applications include gambling, financial, entertainment service, and other types of transactions. The system may include a user location determination feature to prevent users from conducting transactions from unauthorized areas.

14 Claims, 4 Drawing Sheets

Related U.S. Application Data continuation of application No. 13/346,133, filed on Jan. 9, 2012, now abandoned, which is a continuation of application No. 10/835,995, filed on Apr. 29, 2004, now Pat. No. 8,092,303.

(60) Provisional application No. 60/549,187, filed on Mar. 1, 2004, provisional application No. 60/547,507, filed on Feb. 25, 2004.

(58) Field of Classification Search
USPC ..... 463/25
See application file for complete search history.

(56) References Cited

U.S. PATENT DOCUMENTS 3,876,208 A 4/1975 Wachtler et al.
3,929,338 A 12/1975 Busch
4,101,129 A 7/1978 Cox
4,120,294 A 10/1978 Wolfe
4,157,829 A 6/1979 Goldman et al.
4,206,920 A 6/1980 Weatherford et al.
4,216,965 A 8/1980 Morrison et al.
4,238,127 A 12/1980 Lucero et al.
4,240,635 A 12/1980 Brown
4,266,214 A 5/1981 Peters, Jr.
4,335,809 A 6/1982 Wain
4,448,419 A 5/1984 Telnaes
4,467,424 A 8/1984 Hedges et al.
4,492,379 A 1/1985 Okada
4,527,798 A 7/1985 Siekierski et al.
4,572,509 A 2/1986 Stirick
4,573,681 A 3/1986 Okada
4,614,342 A 9/1986 Takashima
4,624,459 A 11/1986 Kaufman
4,636,951 A 1/1987 Harlick
4,648,600 A 3/1987 Oliiges
4,652,998 A 3/1987 Koza et al.
4,692,863 A 9/1987 Moosz
4,760,527 A 7/1988 Sidley
4,805,907 A 2/1989 Hagiwara
4,810,868 A 3/1989 Drexler
4,817,951 A 4/1989 Crouch et al.
4,838,552 A 6/1989 Hagiwara
4,853,884 A 8/1989 Brown et al.
4,856,787 A 8/1989 Itkis
4,858,932 A 8/1989 Keane
4,880,237 A 11/1989 Kishishita
4,882,473 A 11/1989 Bergeron et al.
4,909,516 A 3/1990 Kolinsky
4,926,327 A 5/1990 Sidley
4,959,783 A 9/1990 Scott et al.
4,964,638 A 10/1990 Ishida
5,001,632 A 3/1991 Hall-Tipping
5,007,087 A 4/1991 Bernstein et al.
5,024,441 A 6/1991 Rosseau
5,048,833 A 9/1991 Lamle
5,050,881 A 9/1991 Nagao
5,055,662 A 10/1991 Hasegawa
5,056,141 A 10/1991 Dyke
5,074,559 A 12/1991 Okada
5,083,785 A 1/1992 Okada
5,096,195 A 3/1992 Gimmon
5,096,202 A 3/1992 Hesland
5,102,134 A 4/1992 Smyth
5,151,684 A 9/1992 Johnsen
5,192,076 A 3/1993 Komori
5,229,764 A 7/1993 Matchett et al.
5,242,163 A 9/1993 Fulton
5,251,165 A 10/1993 James, III
5,251,898 A 10/1993 Dickenson et al.
5,263,716 A 11/1993 Smyth
5,265,874 A 11/1993 Dickinson et al.
5,280,426 A 1/1994 Edmonds
5,280,909 A 1/1994 Tracy
5,298,476 A 3/1994 Hotta et al.
5,324,035 A 6/1994 Morris et al.
5,326,104 A 7/1994 Pease et al.
5,344,199 A 9/1994 Carstens et al.
5,351,970 A 10/1994 Fioretti
5,359,183 A 10/1994 Skodlar
5,370,306 A 12/1994 Schulze et al.
5,380,007 A 1/1995 Travis et al.
5,380,008 A 1/1995 Mathis et al.
5,393,061 A 2/1995 Manship et al.
5,398,932 A 3/1995 Eberhardt et al.
5,415,416 A 5/1995 Scagnelli et al.
5,421,576 A 6/1995 Yamazaki et al.
5,429,361 A 7/1995 Raven et al.
5,471,044 A 11/1995 Hotta et al.
5,476,259 A 12/1995 Weingardt
5,505,449 A 4/1996 Eberhardt et al.
5,507,485 A 4/1996 Fisher
5,511,784 A 4/1996 Furry et al.
5,524,888 A 6/1996 Heidel
5,534,685 A 7/1996 Takemoto et al.
5,551,692 A 9/1996 Pettit et al.
5,569,083 A 10/1996 Fioretti
5,569,084 A 10/1996 Nicastro et al.
5,580,309 A 12/1996 Piechowiak et al.
5,586,937 A 12/1996 Menashe
5,588,913 A 12/1996 Hecht
5,599,231 A 2/1997 Hibino et al.
5,613,912 A 3/1997 Slater
5,618,045 A 4/1997 Kagan et al.
5,618,232 A 4/1997 Martin
5,645,277 A 7/1997 Cheng
5,653,634 A 8/1997 Hodges
5,654,746 A 8/1997 McMulan, Jr. et al.
5,655,961 A 8/1997 Acres et al.
5,675,828 A 10/1997 Stoel et al.
5,697,844 A 12/1997 Von Kohorn
5,702,302 A 12/1997 Gauselman
5,707,286 A 1/1998 Carlson
5,738,583 A 4/1998 Comas et al.
5,745,102 A 4/1998 Bloch et al.
5,762,552 A 6/1998 Vuong et al.
5,764,789 A 6/1998 Pare, Jr. et al.
5,766,076 A 6/1998 Pease et al.
5,768,382 A 6/1998 Schneier et al.
5,772,508 A 6/1998 Sugita et al.
5,779,549 A 7/1998 Walker
5,785,595 A 7/1998 Gauselman
5,787,156 A 7/1998 K atz
5,806,849 A 9/1998 Rutkowski
5,816,918 A 10/1998 Kelly et al.
5,816,920 A 10/1998 Hanai
5,851,148 A 10/1998 Brune et al.
5,833,536 A 11/1998 Davids et al.
5,835,722 A 11/1998 Bradshaw et al.
5,836,817 A 11/1998 Acres et al.
5,857,911 A 1/1999 Fioretti
5,871,398 A 2/1999 Schneier et al.
5,878,211 A 3/1999 Delagrange
5,881,366 A 3/1999 Bodernmann et al.
5,889,474 A 3/1999 LaDue
5,902,983 A 5/1999 Crevelt et al.
5,904,619 A 5/1999 Scagnelli et al.
5,904,620 A 5/1999 Kujawa
5,907,282 A 5/1999 Tuorto et al.
5,910,047 A 6/1999 Scagnelli et al.
5,920,640 A 7/1999 Salatino et al.
5,921,865 A 7/1999 Scagnelli
5,923,870 A 7/1999 Johns
5,931,764 A 8/1999 Freeman et al.
5,935,005 A 8/1999 Tsuda et al.
5,951,397 A 9/1999 Dickinson
5,954,583 A 9/1999 Green
5,955,961 A 9/1999 Wallerstein
5,959,596 A 9/1999 McCarten et al.
5,970,143 A 10/1999 Schneier et al.
5,977,957 A 11/1999 Miller et al.
5,987,611 A 11/1999 Freund
5,991,431 A 11/1999 Borza et al.

(56) References Cited

U.S. PATENT DOCUMENTS 5,995,630 A 11/1999 Borza et al.
5,999,808 A 12/1999 LaDue
6,001,015 A 12/1999 Nishiumi et al.
6,001,016 A 12/1999 Walker et al.
6,003,013 A 12/1999 Boushy et al.
6,011,973 A 1/2000 Valentine et al.
6,012,636 A 1/2000 Smith
6,012,982 A 1/2000 Piechowiak et al.
6,019,284 A 2/2000 Freeman et al.
6,022,274 A 2/2000 Takeda et al.
6,027,115 A 2/2000 Griswold et al.
6,044,062 A 3/2000 Brownrigg et al.
6,048,269 A 4/2000 Burns et al.
6,050,622 A 4/2000 Gustafson
6,065,056 A 5/2000 Bradshaw et al.
6,080,061 A 6/2000 Watanabe et al.
6,098,985 A 8/2000 Moody
6,099,408 A 8/2000 Schneier et al.
6,100,804 A 8/2000 Brady et al.
6,104,295 A 8/2000 Gaisser et al.
6,104,815 A 8/2000 Alcorn
6,117,011 A 9/2000 Lvov
6,135,884 A 10/2000 Hedrick et al.
6,139,431 A 10/2000 Walker et al.
6,146,270 A 11/2000 Huard et al.
6,148,094 A 11/2000 Kinsella
6,177,905 B1 1/2001 Welch
6,178,255 B1 1/2001 Scott et al.
6,178,510 B1 1/2001 O'Connoe et al.
6,183,366 B1 2/2001 Goldberg et al.
6,193,153 B1 2/2001 Lambert
6,196,920 B1 3/2001 Spaur et al.
6,210,274 B1 4/2001 Carlson
6,212,392 B1 4/2001 Fitch et al.
6,219,439 B1 4/2001 Burger
6,233,448 B1 5/2001 Alperovich et al.
6,248,017 B1 6/2001 Roach
6,251,014 B1 6/2001 Stockdale et al.
6,251,017 B1 6/2001 Leason et al.
6,264,560 B1 7/2001 Goldberg et al.
6,265,973 B1 7/2001 Brammall et al.
6,272,223 B1 8/2001 Carlson
6,277,026 B1 8/2001 Archer
6,277,029 B1 8/2001 Hanley
6,280,325 B1 8/2001 Fisk
6,287,202 B1 9/2001 Pascal et al.
6,290,601 B1 9/2001 Yamazaki et al.
RE37,414 E 10/2001 Harlick
6,309,307 B1 10/2001 Krause et al.
6,320,495 B1 11/2001 Sporgis
6,325,285 B1 12/2001 Baratelli
6,325,292 B1 12/2001 Sehr
6,331,148 B1 12/2001 Krause et al.
6,359,661 B1 3/2002 Nickum
6,386,976 B1 5/2002 Yamazaki et al.
6,388,612 B1 5/2002 Neher
6,409,602 B1 6/2002 Wiltshire et al.
6,424,029 B1 7/2002 Giesler
6,425,828 B2 7/2002 Walker et al.
6,428,413 B1 8/2002 Carlson
6,441,752 B1 8/2002 Fomukong
6,454,648 B1 9/2002 Kelly
RE37,885 E 10/2002 Acres et al.
6,468,155 B1 10/2002 Zucker
6,507,279 B2 1/2003 Loof
6,508,709 B1 1/2003 Karmarkar
6,508,710 B1 1/2003 Paravia et al.
6,509,217 B1 1/2003 Reddy
6,520,853 B2 2/2003 Suzuki
6,524,189 B1 2/2003 Rautila
6,527,641 B1 3/2003 Sinclair et al.
6,542,750 B2 4/2003 Hendrey et al.
6,554,705 B1 4/2003 Cumbers
6,554,707 B1 4/2003 Sinclair
6,556,819 B2 4/2003 Irvin
6,575,834 B1 6/2003 Lindo
6,577,733 B1 6/2003 Charrin
6,582,302 B2 6/2003 Romero
6,585,597 B2 7/2003 Finn
6,604,980 B1 8/2003 Jurmain et al.
6,612,928 B1 9/2003 Bradford et al.
6,614,350 B1 9/2003 Lunsford
6,618,706 B1 9/2003 Rive et al.
6,622,157 B1 9/2003 Heddaya et al.
6,628,939 B2 9/2003 Paulsen
6,631,849 B2 10/2003 Blossom
6,634,942 B2 10/2003 Walker
6,645,077 B2 11/2003 Rowe
6,652,378 B2 11/2003 Cannon et al.
6,676,522 B2 1/2004 Rowe et al.
6,680,675 B1 1/2004 Suzuki
6,682,421 B1 1/2004 Rowe et al.
6,691,032 B1 2/2004 Irish et al.
6,709,333 B1 3/2004 Bradford et al.
6,719,631 B1 4/2004 Tulley et al.
6,721,542 B1 4/2004 Anttila et al.
6,729,956 B2 5/2004 Wolf et al.
6,743,098 B2 6/2004 Urie et al.
6,745,011 B1 6/2004 Hendrickson
6,749,505 B1 6/2004 Kunzle
6,754,210 B1 6/2004 Ofek
6,755,742 B1 6/2004 Hartman
6,756,882 B2 6/2004 Benes
6,761,638 B1 7/2004 Narita
6,773,350 B2 8/2004 Yoshimi et al.
6,778,820 B2 8/2004 Tendler
6,793,580 B2 9/2004 Sinclair
6,800,029 B2 10/2004 Rowe et al.
6,800,031 B2 10/2004 Di Cesare
6,801,934 B1 10/2004 Eranko
6,802,772 B1 10/2004 Kunzle
6,812,824 B1 11/2004 Goldinger et al.
6,834,195 B2 12/2004 Brandenberg et al.
6,837,789 B2 1/2005 Garahi et al.
6,839,560 B1 1/2005 Bahl et al.
6,843,412 B1 1/2005 Sanford
6,843,725 B2 1/2005 Nelson
6,846,238 B2 1/2005 Wells et al.
6,857,959 B1 2/2005 Nguyen
6,863,610 B2 3/2005 Vancraeynest
6,868,396 B2 3/2005 Smith et al.
6,884,162 B2 4/2005 Raverdy
6,884,166 B2 4/2005 Leen et al.
6,887,151 B2 5/2005 Leen et al.
6,887,159 B2 5/2005 Leen et al.
6,892,218 B2 5/2005 Heddaya et al.
6,892,938 B2 5/2005 Solomon
6,893,347 B1 5/2005 Zilliacus
6,896,618 B2 5/2005 Benoy et al.
6,898,299 B1 5/2005 Brooks
6,899,628 B2 5/2005 Leen et al.
6,904,520 B1 6/2005 Rosset
6,908,387 B2 6/2005 Hedrick et al.
6,908,391 B2 6/2005 Gatto et al.
6,923,724 B2 8/2005 Williams
6,935,952 B2 8/2005 Walker et al.
6,935,958 B2 8/2005 Nelson
6,942,574 B1 9/2005 Lemay et al.
6,945,870 B2 9/2005 Gatto et al.
RE38,812 E 10/2005 Acres et al.
6,966,832 B2 11/2005 Leen et al.
6,979,264 B2 12/2005 Chatigny et al.
6,979,267 B2 12/2005 Leen et al.
6,984,175 B2 1/2006 Nguyen et al.
6,986,055 B2 1/2006 Carlson
6,997,810 B2 2/2006 Cole
7,021,623 B2 4/2006 Leen et al.
7,022,017 B1 4/2006 Halbritter et al.
7,029,394 B2 4/2006 Leen et al.
7,033,276 B2 4/2006 Walker et al.
7,034,683 B2 4/2006 Ghazarian
7,035,653 B2 4/2006 Simon et al.
7,040,987 B2 5/2006 Walker et al.
7,042,360 B2 5/2006 Light et al.

(56) References Cited

U.S. PATENT DOCUMENTS

| | | | |
|---|---|---|---|
| 7,042,391 | B2 | 5/2006 | Meunier et al. |
| 7,043,641 | B1 | 5/2006 | Martinek et al. |
| 7,047,197 | B1 | 5/2006 | Bennett |
| 7,056,217 | B1 | 6/2006 | Pelkey et al. |
| 7,097,562 | B2 | 8/2006 | Gagner |
| 7,081,815 | B2 | 9/2006 | Runyon et al. |
| 7,102,507 | B1 | 9/2006 | Lauren |
| 7,102,509 | B1 | 9/2006 | Anders et al. |
| 7,124,947 | B2 | 10/2006 | Storch |
| 7,125,334 | B2 | 10/2006 | Yamazaki et al. |
| 7,128,482 | B2 | 10/2006 | Meyerhofer et al. |
| 7,133,685 | B2 | 11/2006 | Hose |
| 7,144,011 | B2 | 12/2006 | Asher et al. |
| 7,147,558 | B2 | 12/2006 | Giobbi |
| 7,158,798 | B2 | 1/2007 | Lee et al. |
| 7,168,626 | B2 | 1/2007 | Lerch et al. |
| 7,185,360 | B1 | 2/2007 | Anton et al. |
| 7,194,273 | B2 | 3/2007 | Vaudreuil |
| 7,207,885 | B2 | 4/2007 | Longman |
| 7,228,651 | B1 | 6/2007 | Saari |
| 7,229,354 | B2 | 6/2007 | McNutt et al. |
| 7,229,385 | B2 | 6/2007 | Freeman et al. |
| 7,233,922 | B2 | 6/2007 | Asher et al. |
| 7,248,852 | B2 | 7/2007 | Cabrera et al. |
| 7,270,605 | B2 | 9/2007 | Russell et al. |
| 7,284,708 | B2 | 10/2007 | Martin |
| 7,288,025 | B1 | 10/2007 | Cumbers |
| 7,288,028 | B2 | 10/2007 | Rodriquez et al. |
| 7,290,264 | B1 | 10/2007 | Powers et al. |
| 7,297,062 | B2 | 11/2007 | Gatto et al. |
| 7,306,514 | B2 | 12/2007 | Amaitis et al. |
| 7,311,605 | B2 | 12/2007 | Moser |
| 7,311,606 | B2 | 12/2007 | Amaitis et al. |
| 7,316,619 | B2 | 1/2008 | Nelson |
| 7,341,517 | B2 | 3/2008 | Asher et al. |
| 7,357,717 | B1 | 4/2008 | Cumbers |
| 7,394,405 | B2 | 7/2008 | Godden |
| 7,413,513 | B2 | 8/2008 | Nguyen et al. |
| 7,429,215 | B2 | 9/2008 | Rozkin |
| 7,435,179 | B1 | 10/2008 | Ford |
| 7,437,147 | B1 | 10/2008 | Luciano, Jr. |
| 7,442,124 | B2 | 10/2008 | Asher et al. |
| 7,452,273 | B2 | 11/2008 | Amaitis et al. |
| 7,452,274 | B2 | 11/2008 | Amaitis et al. |
| 7,458,891 | B2 | 12/2008 | Asher et al. |
| 7,460,863 | B2 | 12/2008 | Steelberg et al. |
| 7,479,065 | B1 | 1/2009 | McAllister et al. |
| 7,506,172 | B2 | 3/2009 | Bhakta |
| 7,510,474 | B2 | 3/2009 | Carter |
| 7,534,169 | B2 | 5/2009 | Amaitis et al. |
| 7,546,946 | B2 | 6/2009 | Hefner et al. |
| 7,549,576 | B2 | 6/2009 | Alderucci et al. |
| 7,549,756 | B2 | 6/2009 | Willis et al. |
| 7,562,034 | B2 | 7/2009 | Asher et al. |
| 7,566,270 | B2 | 7/2009 | Amaitis et al. |
| 7,577,847 | B2 | 8/2009 | Nguyen |
| 7,637,810 | B2 | 12/2009 | Amaitis et al. |
| 7,665,668 | B2 | 2/2010 | Phillips |
| 7,686,687 | B2 | 3/2010 | Cannon et al. |
| 7,689,459 | B2 | 3/2010 | Capurso et al. |
| 7,736,221 | B2 | 6/2010 | Black et al. |
| 7,742,972 | B2 | 6/2010 | Lange et al. |
| 7,744,002 | B2 | 6/2010 | Jones et al. |
| 7,819,749 | B1 | 10/2010 | Fish et al. |
| 7,828,652 | B2 | 11/2010 | Nguyen et al. |
| 7,828,661 | B1 | 11/2010 | Fish et al. |
| 7,867,083 | B2 | 1/2011 | Wells et al. |
| 7,946,917 | B2 | 5/2011 | Kaminkow et al. |
| 7,967,682 | B2 | 6/2011 | Huizinga |
| 8,047,914 | B2 | 11/2011 | Morrow |
| 8,092,303 | B2 | 1/2012 | Amaitis et al. |
| 8,123,616 | B2 | 2/2012 | Wells et al. |
| 8,142,283 | B2 | 3/2012 | Lutnick |
| 8,162,756 | B2 | 4/2012 | Amaitis et al. |
| 8,221,225 | B2 | 7/2012 | Laut |
| 8,267,789 | B2 | 9/2012 | Nelson |
| 8,285,484 | B1 | 10/2012 | Lau |
| 8,287,380 | B2 | 10/2012 | Nguyen |
| 8,298,078 | B2 | 10/2012 | Sutton et al. |
| 8,308,568 | B2 | 11/2012 | Amaitis et al. |
| 8,393,948 | B2 | 3/2013 | Allen |
| 8,425,314 | B2 | 4/2013 | Benbrahim |
| 8,616,967 | B2 | 12/2013 | Amaitis et al. |
| 8,696,443 | B2 | 4/2014 | Amaitis et al. |
| 8,764,566 | B2 | 7/2014 | Miltenberger |
| 2001/0018663 | A1 | 8/2001 | Dusell et al. |
| 2001/0026240 | A1 | 10/2001 | Neher |
| 2001/0026610 | A1 | 10/2001 | Katz et al. |
| 2001/0026632 | A1 | 10/2001 | Tamai |
| 2001/0027130 | A1 | 10/2001 | Namba et al. |
| 2001/0028308 | A1 | 10/2001 | De La Huerga |
| 2001/0031663 | A1 | 10/2001 | Johnson |
| 2001/0034237 | A1* | 10/2001 | Garahi ..... G07F 17/3223 455/456.3 |
| 2001/0034268 | A1 | 10/2001 | Thomas et al. |
| 2001/0036858 | A1 | 11/2001 | McNutt et al. |
| 2001/0049275 | A1 | 12/2001 | Pierry et al. |
| 2001/0055991 | A1 | 12/2001 | Hightower |
| 2002/0002075 | A1 | 1/2002 | Rowe |
| 2002/0013827 | A1 | 1/2002 | Edstrom et al. |
| 2002/0034978 | A1 | 3/2002 | Legge et al. |
| 2002/0037767 | A1 | 3/2002 | Ebin |
| 2002/0049909 | A1 | 4/2002 | Jackson et al. |
| 2002/0052231 | A1 | 5/2002 | Fioretti |
| 2002/0065097 | A1 | 5/2002 | Brockenbrough |
| 2002/0068631 | A1 | 6/2002 | Raverdy |
| 2002/0073021 | A1 | 6/2002 | Ginsberg et al. |
| 2002/0074725 | A1 | 6/2002 | Stern |
| 2002/0087505 | A1 | 7/2002 | Smith |
| 2002/0094869 | A1 | 7/2002 | Harkham |
| 2002/0095586 | A1 | 7/2002 | Doyle et al. |
| 2002/0099812 | A1* | 7/2002 | Davis ..... H04L 29/12009 709/224 |
| 2002/0111210 | A1 | 8/2002 | Luciano |
| 2002/0111213 | A1 | 8/2002 | McEntee et al. |
| 2002/0119817 | A1 | 8/2002 | Behm |
| 2002/0123377 | A1 | 9/2002 | Shulman |
| 2002/0124182 | A1 | 9/2002 | Basco |
| 2002/0125886 | A1 | 9/2002 | Bates et al. |
| 2002/0128057 | A1 | 9/2002 | Walker et al. |
| 2002/0132663 | A1 | 9/2002 | Cumbers |
| 2002/0142839 | A1 | 10/2002 | Wolinsky |
| 2002/0142844 | A1 | 10/2002 | Kerr |
| 2002/0142846 | A1 | 10/2002 | Paulsen |
| 2002/0143960 | A1 | 10/2002 | Goren |
| 2002/0143991 | A1 | 10/2002 | Chow et al. |
| 2002/0147047 | A1 | 10/2002 | Letovsky |
| 2002/0147049 | A1 | 10/2002 | Carter, Sr. |
| 2002/0151344 | A1 | 10/2002 | Tanskanen |
| 2002/0155884 | A1 | 10/2002 | Updike |
| 2002/0157090 | A1 | 10/2002 | Anton, Jr. |
| 2002/0160834 | A1 | 10/2002 | Urie et al. |
| 2002/0160838 | A1 | 10/2002 | Kim |
| 2002/0165020 | A1 | 11/2002 | Koyama |
| 2002/0174336 | A1 | 11/2002 | Sakakibara et al. |
| 2002/0183105 | A1 | 12/2002 | Cannon et al. |
| 2002/0184653 | A1 | 12/2002 | Pierce et al. |
| 2002/0191017 | A1 | 12/2002 | Sinclair |
| 2002/0198044 | A1 | 12/2002 | Walker |
| 2002/0198051 | A1 | 12/2002 | Lobel et al. |
| 2003/0003988 | A1 | 1/2003 | Walker et al. |
| 2003/0003997 | A1 | 1/2003 | Vuong et al. |
| 2003/0008662 | A1 | 1/2003 | Stern et al. |
| 2003/0009603 | A1 | 1/2003 | Ruths et al. |
| 2003/0013438 | A1 | 1/2003 | Darby |
| 2003/0013513 | A1 | 1/2003 | Rowe |
| 2003/0014639 | A1 | 1/2003 | Jackson et al. |
| 2003/0017871 | A1 | 1/2003 | Urie et al. |
| 2003/0027631 | A1 | 2/2003 | Hedrick et al. |
| 2003/0028567 | A1 | 2/2003 | Carlson |
| 2003/0031321 | A1 | 2/2003 | Mages |
| 2003/0032407 | A1 | 2/2003 | Mages |
| 2003/0032434 | A1 | 2/2003 | Willner et al. |
| 2003/0032474 | A1 | 2/2003 | Kaminkow et al. |

(56) References Cited

U.S. PATENT DOCUMENTS

2003/0036425 A1 2/2003 Kaminkow et al.
2003/0036428 A1 2/2003 Aasland
2003/0040324 A1 2/2003 Eldering et al.
2003/0045269 A1 3/2003 Himmel et al.
2003/0045353 A1 3/2003 Paulsen et al.
2003/0045354 A1 3/2003 Globbi
2003/0045358 A1 3/2003 Leen et al.
2003/0050115 A1 3/2003 Leen et al.
2003/0054878 A1 3/2003 Benoy et al.
2003/0060286 A1 3/2003 Walker
2003/0064712 A1 4/2003 Gaston
2003/0064798 A1 4/2003 Grauzer et al.
2003/0064805 A1* 4/2003 Wells ..... G07F 17/3218 463/39
2003/0064807 A1 4/2003 Walker et al.
2003/0065805 A1 4/2003 Barnes, Jr.
2003/0069071 A1 4/2003 Britt et al.
2003/0069940 A1 4/2003 Kavacheri et al.
2003/0078101 A1 4/2003 Schneider et al.
2003/0087652 A1 5/2003 Simon et al.
2003/0087701 A1 5/2003 Paravia et al.
2003/0104851 A1 6/2003 Merari
2003/0104865 A1 6/2003 Itkis et al.
2003/0109306 A1 6/2003 Karmarkar
2003/0109310 A1 6/2003 Heaton et al.
2003/0114218 A1 6/2003 McClintic
2003/0125973 A1 7/2003 Mathews
2003/0130032 A1 7/2003 Martinek et al.
2003/0139190 A1 7/2003 Steelberg
2003/0140131 A1 7/2003 Chandrashekhar
2003/0148809 A1 8/2003 Nelson
2003/0148812 A1 8/2003 Paulsen et al.
2003/0157976 A1 8/2003 Simon
2003/0162580 A1 8/2003 Cousineau
2003/0162593 A1 8/2003 Griswold et al.
2003/0162594 A1 8/2003 Rowe
2003/0165293 A1 9/2003 Abeles et al.
2003/0173408 A1 9/2003 Mosher et al.
2003/0176162 A1 9/2003 Planki
2003/0176218 A1 9/2003 Lemay
2003/0177187 A1 9/2003 Levine et al.
2003/0177347 A1 9/2003 Schneier et al.
2003/0190944 A1 10/2003 Manfredi et al.
2003/0195037 A1 10/2003 Vuong et al.
2003/0195043 A1 10/2003 Shinners et al.
2003/0195841 A1 10/2003 Ginsberg et al.
2003/0208684 A1 11/2003 Camacho et al.
2003/0212996 A1 11/2003 Wolzien
2003/0224855 A1 12/2003 Cunningham
2003/0228895 A1 12/2003 Edelson
2003/0228898 A1 12/2003 Rowe
2003/0228901 A1 12/2003 Walker et al.
2003/0228907 A1 12/2003 Gatto et al.
2003/0228910 A1 12/2003 Jawaharla et al.
2003/0236120 A1 12/2003 Reece
2004/0002355 A1 1/2004 Spencer
2004/0002383 A1 1/2004 Lundy
2004/0002386 A1 1/2004 Wolfe et al.
2004/0002843 A1 1/2004 Robarts
2004/0005919 A1 1/2004 Walker
2004/0009812 A1 1/2004 Scott et al.
2004/0014522 A1 1/2004 Walker et al.
2004/0029635 A1 2/2004 Giobbi
2004/0034775 A1 2/2004 Desjardins et al.
2004/0038734 A1 2/2004 Adams
2004/0044774 A1 3/2004 Mangalik et al.
2004/0048613 A1 3/2004 Sayers
2004/0053692 A1 3/2004 Chatigny et al.
2004/0061646 A1 4/2004 Andrews et al.
2004/0063497 A1 4/2004 Gould
2004/0066296 A1 4/2004 Atherton
2004/0067760 A1 4/2004 Menjo et al.
2004/0068441 A1 4/2004 Werbitt
2004/0068532 A1 4/2004 Dewing
2004/0083394 A1 4/2004 Brebner et al.
2004/0092306 A1 5/2004 George et al.
2004/0092311 A1 5/2004 Weston
2004/0097283 A1 5/2004 Piper
2004/0097287 A1 5/2004 Postrel
2004/0104274 A1 6/2004 Kotik et al.
2004/0104845 A1 6/2004 McCarthy
2004/0110565 A1 6/2004 Levesque
2004/0111369 A1 6/2004 Lane et al.
2004/0118930 A1 6/2004 Berardi et al.
2004/0121841 A1 6/2004 Xidos et al.
2004/0127277 A1 7/2004 Walker et al.
2004/0127289 A1 7/2004 Davis
2004/0132530 A1 7/2004 Rutanen
2004/0137983 A1 7/2004 Kerr et al.
2004/0137987 A1 7/2004 Nguyen et al.
2004/0142744 A1 7/2004 Atkinson et al.
2004/0147323 A1 7/2004 Cliff et al.
2004/0152511 A1 8/2004 Nicely
2004/0162124 A1 8/2004 Barton
2004/0162144 A1 8/2004 Loose
2004/0185881 A1 9/2004 Lee et al.
2004/0186768 A1 9/2004 Wakim et al.
2004/0189470 A1 9/2004 Girvin et al.
2004/0192438 A1 9/2004 Wells et al.
2004/0192442 A1 9/2004 Wells et al.
2004/0193469 A1 9/2004 Amaitis et al.
2004/0193531 A1 9/2004 Amaitis et al.
2004/0198386 A1 10/2004 Dupray
2004/0198396 A1 10/2004 Fransioli
2004/0198398 A1 10/2004 Amir et al.
2004/0198403 A1 10/2004 Pedersen et al.
2004/0198483 A1 10/2004 Amaitis et al.
2004/0209660 A1 10/2004 Carlson
2004/0209690 A1 10/2004 Bruzzese
2004/0219961 A1 11/2004 Ellenby
2004/0224769 A1 11/2004 Hansen
2004/0225565 A1 11/2004 Selman
2004/0229685 A1 11/2004 Smith
2004/0229699 A1 11/2004 Gentles et al.
2004/0242297 A1 12/2004 Walker
2004/0242322 A1 12/2004 Montagna
2004/0242332 A1 12/2004 Walker et al.
2004/0243504 A1 12/2004 Asher et al.
2004/0248637 A1 12/2004 Liebenberg et al.
2004/0248653 A1 12/2004 Barros et al.
2004/0259631 A1 12/2004 Katz et al.
2004/0266533 A1 12/2004 Gentles et al.
2005/0001711 A1 1/2005 Doughty et al.
2005/0003881 A1 1/2005 Byng
2005/0003888 A1 1/2005 Asher et al.
2005/0003893 A1 1/2005 Hogwood et al.
2005/0009600 A1 1/2005 Rowe et al.
2005/0014554 A1 1/2005 Walker et al.
2005/0020336 A1 1/2005 Cesare
2005/0020340 A1 1/2005 Cannon
2005/0026697 A1 2/2005 Balahura
2005/0027643 A1 2/2005 Amaitis et al.
2005/0043996 A1 2/2005 Silver
2005/0049022 A1 3/2005 Mullen
2005/0049949 A1 3/2005 Asher et al.
2005/0054439 A1 3/2005 Rowe et al.
2005/0059397 A1 3/2005 Zhao
2005/0059485 A1 3/2005 Paulsen
2005/0064934 A1 3/2005 Amaitis et al.
2005/0071481 A1 3/2005 Danieli
2005/0086301 A1 4/2005 Eichler et al.
2005/0090294 A1 4/2005 Narasimhan
2005/0096109 A1 5/2005 McNutt et al.
2005/0096133 A1 5/2005 Hoefelmeyer et al.
2005/0101383 A1 5/2005 Wells
2005/0107022 A1 5/2005 Wichelmann
2005/0107156 A1 5/2005 Potts et al.
2005/0108365 A1 5/2005 Becker et al.
2005/0113172 A1 5/2005 Gong
2005/0116020 A1 6/2005 Smolucha et al.
2005/0130677 A1 6/2005 Meunier et al.
2005/0130728 A1 6/2005 Ngyuen
2005/0131815 A1 6/2005 Fung et al.
2005/0137014 A1 6/2005 Vetelainen

(56) References Cited

U.S. PATENT DOCUMENTS

2005/0143169 A1 6/2005 Ngyuen et al.
2005/0144484 A1 6/2005 Wakayama
2005/0159212 A1 7/2005 Romney et al.
2005/0170845 A1 8/2005 Moran
2005/0170886 A1 8/2005 Miller
2005/0170890 A1 8/2005 Rowe et al.
2005/0170892 A1 8/2005 Atkinson
2005/0181859 A1 8/2005 Lind et al.
2005/0181862 A1 8/2005 Asher et al.
2005/0181870 A1 8/2005 Nguyen et al.
2005/0187000 A1 8/2005 Miller
2005/0187020 A1 8/2005 Amaitis et al.
2005/0190901 A1 9/2005 Oborn et al.
2005/0192077 A1 9/2005 Okuniewicz
2005/0193118 A1 9/2005 Le et al.
2005/0193209 A1 9/2005 Saunders et al.
2005/0197189 A1 9/2005 Schultz
2005/0197190 A1 9/2005 Amaitis et al.
2005/0209002 A1 9/2005 Blythe et al.
2005/0215306 A1 9/2005 O'Donnell et al.
2005/0234774 A1 10/2005 Dupree
2005/0239523 A1 10/2005 Longman et al.
2005/0239524 A1 10/2005 Longman et al.
2005/0239546 A1 10/2005 Hedrick et al.
2005/0243774 A1 10/2005 Dupree
2005/0245306 A1 11/2005 Asher et al.
2005/0245308 A1 11/2005 Amaitis et al.
2005/0251440 A1 11/2005 Bednarek
2005/0261061 A1 11/2005 Nguyen et al.
2005/0277471 A1 12/2005 Russell et al.
2005/0277472 A1 12/2005 Gillan et al.
2005/0282638 A1 12/2005 Rowe et al.
2005/0288937 A1 12/2005 Verdiramo
2006/0005050 A1 1/2006 Basson et al.
2006/0009279 A1 1/2006 Amaitis et al.
2006/0016877 A1 1/2006 Bonalle et al.
2006/0019745 A1 1/2006 Benbrahim
2006/0121987 A1 1/2006 Bortnik et al.
2006/0121992 A1 1/2006 Bortnik et al.
2006/0035707 A1 2/2006 Nguyen et al.
2006/0040717 A1 2/2006 Lind et al.
2006/0040741 A1 2/2006 Grisworld et al.
2006/0052153 A1 3/2006 Vlazny et al.
2006/0058102 A1 3/2006 Nguyen et al.
2006/0068917 A1 3/2006 Snoddy et al.
2006/0069711 A1 3/2006 Tsunekawa et al.
2006/0076406 A1 4/2006 Frerking
2006/0093142 A1 5/2006 Schneier et al.
2006/0095790 A1 5/2006 Nguyen et al.
2006/0100019 A1 5/2006 Hornik et al.
2006/0116198 A1 6/2006 Leen et al.
2006/0116199 A1 6/2006 Leen et al.
2006/0116200 A1 6/2006 Leen et al.
2006/0121970 A1 6/2006 Khal
2006/0131391 A1 6/2006 Penuela
2006/0135252 A1 6/2006 Amaitis et al.
2006/0135259 A1 6/2006 Nancke-Krogh et al.
2006/0136296 A1 6/2006 Amada
2006/0148560 A1 7/2006 Arezina et al.
2006/0148561 A1 7/2006 Moser
2006/0160626 A1 7/2006 Gatto et al.
2006/0163346 A1 7/2006 Lee et al.
2006/0165235 A1 7/2006 Carlson
2006/0166740 A1 7/2006 Sufuentes
2006/0173754 A1 8/2006 Burton et al.
2006/0178216 A1 8/2006 Shea et al.
2006/0183522 A1 8/2006 Leen et al.
2006/0184417 A1 8/2006 Van der Linden et al.
2006/0187029 A1 8/2006 Thomas
2006/0189382 A1 8/2006 Muir et al.
2006/0194589 A1 8/2006 Saniska
2006/0199649 A1 9/2006 Soltys et al.
2006/0205489 A1 9/2006 Carpenter et al.
2006/0205497 A1 9/2006 Wells et al.
2006/0209810 A1 9/2006 Krzyzanowski et al.
2006/0224046 A1 10/2006 Ramadas et al.
2006/0229520 A1 10/2006 Yamashita
2006/0234631 A1 10/2006 Dieguez
2006/0234791 A1 10/2006 Nguyen et al.
2006/0236395 A1 10/2006 Barker et al.
2006/0246990 A1 11/2006 Downes
2006/0247026 A1 11/2006 Walker et al.
2006/0247039 A1 11/2006 Lerner et al.
2006/0247041 A1 11/2006 Walker et al.
2006/0247053 A1 11/2006 Mattila
2006/0252501 A1 11/2006 Little et al.
2006/0252530 A1 11/2006 Oberberger et al.
2006/0258429 A1 11/2006 Manning et al.
2006/0277098 A1 12/2006 Chung et al.
2006/0277308 A1 12/2006 Morse et al.
2006/0277413 A1 12/2006 Drews
2006/0281541 A1 12/2006 Nguyen et al.
2006/0287092 A1 12/2006 Walker et al.
2006/0287098 A1 12/2006 Morrow et al.
2006/0293965 A1 12/2006 Burton
2007/0001841 A1 1/2007 Anders et al.
2007/0003034 A1 1/2007 Schultz et al.
2007/0015564 A1 1/2007 Walker et al.
2007/0021213 A1 1/2007 Foe et al.
2007/0026939 A1 2/2007 Asher et al.
2007/0030154 A1 2/2007 Aiki et al.
2007/0032301 A1 2/2007 Acres et al.
2007/0054739 A1 3/2007 Amaitis et al.
2007/0060305 A1 3/2007 Amaitis et al.
2007/0060306 A1 3/2007 Amaitis et al.
2007/0060312 A1 3/2007 Dempsey et al.
2007/0060326 A1 3/2007 Juds et al.
2007/0060355 A1 3/2007 Amaitis et al.
2007/0060358 A1 3/2007 Amaitis et al.
2007/0066401 A1 3/2007 Amaitis
2007/0066402 A1 3/2007 Amaitis
2007/0087834 A1 4/2007 Moser et al.
2007/0087843 A1 4/2007 Steil et al.
2007/0093296 A1 4/2007 Asher et al.
2007/0099697 A1 5/2007 Nelson
2007/0099703 A1 5/2007 Terebilo
2007/0117604 A1 5/2007 Hill
2007/0117634 A1 5/2007 Hamilton et al.
2007/0130044 A1 6/2007 Rowan
2007/0136817 A1 6/2007 Ngyuen
2007/0167237 A1 7/2007 Wang et al.
2007/0168570 A1 7/2007 Martin et al.
2007/0181676 A1 8/2007 Mateen et al.
2007/0190494 A1 8/2007 Rosenberg
2007/0191719 A1 8/2007 Yamashita et al.
2007/0213120 A1 9/2007 Beal et al.
2007/0233585 A1 10/2007 Ben Simon et al.
2007/0235807 A1 10/2007 Sobel et al.
2007/0238443 A1 10/2007 Richardson
2007/0241187 A1 10/2007 Alderucci et al.
2007/0243927 A1 10/2007 Soltys
2007/0243935 A1 10/2007 Huizinga
2007/0257101 A1 11/2007 Alderucci et al.
2007/0258507 A1 11/2007 Lee et al.
2007/0259717 A1 11/2007 Mattice et al.
2007/0275779 A1 11/2007 Amaitis
2007/0281782 A1 12/2007 Amaitis
2007/0281785 A1 12/2007 Amaitis
2007/0281792 A1 12/2007 Amaitis
2007/0282959 A1 12/2007 Stern
2008/0004121 A1 1/2008 Gatto et al.
2008/0009344 A1 1/2008 Graham et al.
2008/0015013 A1 1/2008 Gelman et al.
2008/0022089 A1 1/2008 Leedom
2008/0026829 A1 1/2008 Martin et al.
2008/0026844 A1 1/2008 Wells et al.
2008/0032801 A1 2/2008 Brunet de Courssou
2008/0039196 A1 2/2008 Walther et al.
2008/0051193 A1 2/2008 Kaminkow et al.
2008/0066111 A1 3/2008 Ellis et al.
2008/0076505 A1 3/2008 Nguyen et al.
2008/0076506 A1 3/2008 Nguyen et al.
2008/0076572 A1 3/2008 Nguyen et al.
2008/0096628 A1 4/2008 Czyzewski et al.

(56) References Cited

U.S. PATENT DOCUMENTS

2008/0096659 A1 4/2008 Kreloff et al.
2008/0102956 A1 5/2008 Burman et al.
2008/0102957 A1 5/2008 Burman et al.
2008/0108423 A1 5/2008 Benbrahim et al.
2008/0113785 A1 5/2008 Alderucci et al.
2008/0113786 A1 5/2008 Alderucci et al.
2008/0113787 A1 5/2008 Alderucci et al.
2008/0113816 A1 5/2008 Mahaffey et al.
2008/0139306 A1 6/2008 Lutnick
2008/0146323 A1 6/2008 Hardy et al.
2008/0150678 A1 6/2008 Giobbi et al.
2008/0182644 A1 7/2008 Lutnick et al.
2008/0195664 A1 8/2008 Maharajh et al.
2008/0207302 A1 8/2008 Lind et al.
2008/0214261 A1 9/2008 Alderucci et al.
2008/0218312 A1 9/2008 Asher et al.
2008/0220871 A1 9/2008 Asher et al.
2008/0221396 A1 9/2008 Garces et al.
2008/0224822 A1 9/2008 Asher et al.
2008/0254897 A1 10/2008 Saunders et al.
2008/0305856 A1 12/2008 Walker et al.
2008/0305867 A1 12/2008 Guthrie
2008/0311994 A1 12/2008 Amaitis et al.
2008/0318670 A1 12/2008 Zinder et al.
2009/0049542 A1 2/2009 DeYonker et al.
2009/0055204 A1 2/2009 Pennington et al.
2009/0088232 A1 4/2009 Amaitis et al.
2009/0098925 A1 4/2009 Gagner et al.
2009/0117989 A1 5/2009 Arezina et al.
2009/0149233 A1 6/2009 Strause et al.
2009/0163272 A1 6/2009 Baker et al.
2009/0178118 A1 7/2009 Cedo et al.
2009/0183208 A1 7/2009 Christensen et al.
2009/0197684 A1 8/2009 Arezina et al.
2009/0204905 A1 8/2009 Toghia
2009/0209233 A1 8/2009 Morrison
2009/0325708 A9 12/2009 Kerr
2010/0023372 A1 1/2010 Gonzalez
2010/0029381 A1* 2/2010 Vancura ..... G07F 17/3244 463/30
2010/0062834 A1 3/2010 Ryan
2010/0069144 A1 3/2010 Curtis
2010/0069158 A1 3/2010 Kim
2010/0075760 A1 3/2010 Shimabukuro et al.
2010/0113143 A1 5/2010 Gagner et al.
2010/0153511 A1 6/2010 Lin
2010/0205255 A1 8/2010 Alderucci
2010/0211431 A1 8/2010 Lutnick
2010/0227691 A1 9/2010 Karsten
2010/0240455 A1 9/2010 Gagner et al.
2011/0269520 A1 11/2011 Amaitis et al.
2012/0115588 A1 5/2012 Amaitis et al.
2012/0190452 A1 7/2012 Weston et al.
2012/0289318 A1 11/2012 Amaitis et al.
2012/0289319 A1 11/2012 Amaitis et al.
2012/0289320 A1 11/2012 Amaitis et al.
2012/0289321 A1 11/2012 Amaitis et al.
2013/0005454 A1 1/2013 Amaitis et al.
2013/0005486 A1 1/2013 Amaitis et al.
2013/0065672 A1 3/2013 Gelman et al.
2013/0065679 A1 3/2013 Gelman et al.
2013/0072295 A1 3/2013 Alderucci et al.
2013/0084933 A1 4/2013 Amaitis et al.
2013/0165212 A1 6/2013 Amaitis et al.
2013/0165213 A1 6/2013 Alderucci et al.
2013/0165221 A1 6/2013 Alderucci et al.
2013/0178277 A1 7/2013 Burman et al.
2013/0210513 A1 8/2013 Nguyen
2013/0244742 A1 9/2013 Amaitis et al.
2014/0057724 A1 2/2014 Alderucci et al.
2014/0113707 A1 4/2014 Asher et al.
2014/0200465 A1 7/2014 McIntyre
2014/0220514 A1 8/2014 Waldron et al.
2014/0228127 A1 8/2014 Alderucci et al.
2014/0288401 A1 9/2014 Ouwerkerk et al.
2014/0300491 A1 10/2014 Chen
2015/0080111 A1 3/2015 Amaitis et al.
2015/0141131 A1 5/2015 Gelman et al.
2016/0055709 A1 2/2016 Amaitis et al.

FOREIGN PATENT DOCUMENTS

DE 37 36 770 A1 5/1989
DE 43 16 652 A1 11/1994
DE 19922862 12/2000
DE 19944140 3/2001
DE 19952691 5/2001
DE 19952692 5/2001
DE 10060079 6/2002
EA 0 840 639 B1 7/1996
EP 0 506 873 B1 3/2000
EP 1045346 10/2000
EP 1063622 12/2000
EP 1 066 868 A2 1/2001
EP 1066867 1/2001
EP 1120757 1/2001
EP 1 202 528 A3 5/2002
EP 1217792 6/2002
EP 1231577 8/2002
EP 1304147 4/2003
EP 1 475 755 A1 12/2003
EP 1 475 756 A2 11/2004
EP 1480102 A2 11/2004
EP 1 531 646 A1 5/2005
GB 2 248 404 4/1992
GB 2 256 594 12/1992
GB 2 391 432 2/2004
GB 2 391 767 2/2004
GB 2394675 5/2004
JP H11-220766 1/1988
JP 05-317485 12/1993
JP H07-281780 10/1995
JP 2000-69540 8/1998
JP 2000-160016 6/2000
JP 2001-70658 3/2001
JP 2001-187271 7/2001
JP 2001-204971 7/2001
JP 2001-204972 7/2001
JP 2001/212363 8/2001
JP 2001 236458 8/2001
JP 2001-340656 12/2001
JP 2001-344400 12/2001
JP 2001-526550 12/2001
JP 2002 032515 1/2002
JP 2002-049681 2/2002
JP 2002-056270 2/2002
JP 2002107224 2/2002
JP 2002-109376 4/2002
JP 2002-66144 5/2002
JP 2002 133009 5/2002
JP 2002-135468 5/2002
JP 2002-175296 6/2002
JP 2002 189831 7/2002
JP 2002-253866 9/2002
JP 2002-263375 9/2002
JP 2002281566 9/2002
JP 2002-292113 10/2002
JP 2003-053042 2/2003
JP 2003-062353 3/2003
JP 2003 078591 3/2003
JP 2003-518677 6/2003
JP 2003-210831 7/2003
JP 2003-210852 7/2003
JP 2004030274 A 1/2004
JP 2002 149894 5/2004
JP 2004-261202 9/2004
JP 2004-321558 11/2004
JP 2004-536638 12/2004
JP 2005-073711 3/2005
JP 2006-072468 3/2006
JP 2007-011420 1/2007
RU 2190477 10/2002
WO WO93/10508 5/1993
WO WO 94/10658 5/1994

(56) References Cited

FOREIGN PATENT DOCUMENTS

| | | | |
|---|---|---|---|
| WO | WO 94/16416 | | 7/1994 |
| WO | WO 95/24689 | | 9/1995 |
| WO | WO97/19537 | | 5/1997 |
| WO | WO97/44750 | | 11/1997 |
| WO | WO 99/04873 | A1 | 2/1999 |
| WO | WO 99/08762 | A1 | 2/1999 |
| WO | WO 99/19027 | | 4/1999 |
| WO | WO99/42964 | | 8/1999 |
| WO | WO 99/52077 | | 10/1999 |
| WO | WO 1999/055102 | | 10/1999 |
| WO | 200030729 | | 6/2000 |
| WO | WO 00/77753 | A1 | 12/2000 |
| WO | WO 2001/017262 | A1 | 3/2001 |
| WO | WO 01/40978 | A2 | 6/2001 |
| WO | WO 01/48712 | A1 | 7/2001 |
| WO | WO 01/48713 | | 7/2001 |
| WO | WO 01/54091 | | 7/2001 |
| WO | 01/67218 | | 9/2001 |
| WO | WO 01/77861 | | 10/2001 |
| WO | WO 01/82176 | | 11/2001 |
| WO | WO 01/84817 | A1 | 11/2001 |
| WO | WO 01/89233 | A3 | 11/2001 |
| WO | WO 02/10931 | A1 | 2/2002 |
| WO | WO 02/21457 | A1 | 3/2002 |
| WO | WO 02/31739 | | 4/2002 |
| WO | WO 02/37246 | | 5/2002 |
| WO | WO 02/39605 | A1 | 5/2002 |
| WO | WO 02/41199 | A3 | 5/2002 |
| WO | WO 02/47042 | | 6/2002 |
| WO | WO 2002/065750 | A2 | 8/2002 |
| WO | WO 02/071351 | A2 | 9/2002 |
| WO | WO 02/077931 | A1 | 10/2002 |
| WO | WO02/101486 | | 12/2002 |
| WO | WO 2003/005743 | | 1/2003 |
| WO | WO 03/013678 | A1 | 2/2003 |
| WO | WO 2003/015299 | | 2/2003 |
| WO | WO 03/021543 | | 3/2003 |
| WO | WO 03/027970 | A2 | 4/2003 |
| WO | 03/045519 | | 6/2003 |
| WO | 03/081447 | | 10/2003 |
| WO | WO 2004/003810 | A1 | 1/2004 |
| WO | WO 2004/013820 | | 2/2004 |
| WO | WO 2004/014506 | A1 | 2/2004 |
| WO | WO 2004/023253 | A3 | 3/2004 |
| WO | WO 2004/027689 | | 4/2004 |
| WO | WO 2004/034223 | | 4/2004 |
| WO | WO 2004/073812 | A2 | 9/2004 |
| WO | WO 2004/095383 | | 11/2004 |
| WO | WO 2004/104763 | A2 | 12/2004 |
| WO | WO 2004/109321 | | 12/2004 |
| WO | WO 2004/114235 | A1 | 12/2004 |
| WO | WO 2005/001651 | | 1/2005 |
| WO | WO 2005/009567 | | 2/2005 |
| WO | WO 2005/015458 | A1 | 2/2005 |
| WO | WO 2005/022453 | | 3/2005 |
| WO | WO 2005/026870 | A2 | 3/2005 |
| WO | WO 2005/031627 | A1 | 4/2005 |
| WO | WO 2005/031666 | A1 | 4/2005 |
| WO | WO 2005/036425 | A1 | 4/2005 |
| WO | WO 2005/082011 | | 9/2005 |
| WO | WO 2005/085980 | | 9/2005 |
| WO | WO2005/098650 | | 10/2005 |
| WO | 2006/023230 | | 3/2006 |
| WO | WO 2007/008601 | A2 | 1/2007 |
| WO | WO 2008/005264 | | 1/2008 |
| WO | WO 2008/016610 | | 2/2008 |

OTHER PUBLICATIONS

Notification of Transmittal of the International Search Report and the Written Opinion of the International Searching Authority, or the Declaration for International Application No. PCT/US08/56120, 14 pages, 8/29/8.

U.S. PTO Office Action for U.S. Appl. No. 11/256,568; 17 pages; dated Oct. 21, 2008.

Office Action for U.S. Appl. No. 11/063,311 entitled System and Method for Convenience Gaming by Lee M. Amaitis, et al.; dated Jul. 10, 2008.

U.S. Office Action for U.S. Appl. No. 11/199,835, filed Aug. 9, 2005; 17 pages; dated Mar. 2, 2007.

Australian Patent Office Written Opinion and Search Report for Application No. SG 200605830-9; 11 pages; dated Nov. 29, 2007.

Notification of Transmittal of the International Search Report and the Written Opinion of the. International Searching Authority for International Application No. PCT/US06/26348; 9 pages; dated Dec. 28, 2007.

United States Patent and Trademark Office: Office Action for U.S. Appl. No. 11/063,311, filed Feb. 21, 2005, in the name of Lee M. Amaitis; 18 pages; dated May 4, 2007.

United States Patent and Trademark Office: Office Action for U.S. Appl. No. 11/063,311, filed Feb. 21, 2005 in the name of Lee M. Amaitis; 27 pages; dated Oct. 31, 2007.

Janna Lindsjö, et al.; *GIGANT—an Interactive, Social, Physical and Mobile Game*; PDC 2002 Proceedings of the Participatory Design Conference; Malmö, Sweden; 5 pages; Jun. 23-25, 2002.

Notification of Transmittal of the International Search Report and the Written Opinion of the International Searching Authority for International Application PCT/US06/26599; 7 pages; dated Sep. 24, 2007.

Notification of Transmittal of the International Search Report and the Written Opinion of the. International Searching Authority for International Application PCT/US06/06315; 10 pages; dated Sep. 24, 2007.

USPTO Office Action Summary for U.S. Appl. No. 11/201,812 filed Aug. 10, 2005; 32 pages; dated Sep. 27, 2007.

Stephan Neuert, et al.; The British Library; *Delivering Seamless Mobile Services Over Bluetooth*; 11 pages; Oct. 2002.

Business Wire; *Home Gambling Network Inc.*, With U.S. Pat. No. 5,800,268—*Business/Gambling—HGN and UUNET, a WorldCom/MCI Company, Reach a Mutually Satisfactory Resolution in Patent Suit*; 2 pages; Mar. 19, 1999.

PR Newswire; *Nokia N-Gage (TM) Mobile Game Deck—The Revolutionary Gaming Experience; Major Global Games Publishers Excited to Publish on Wireless Multiplayer Platform*; 3 pages; Feb. 6, 2003.

Business Wire; *GoldPocket Interactive Launches EM Mobile Matrix, Industry's First Fully Synchronous Interactive Television and Massively Multi-Player Gaming Solution*; 2 pages; Mar. 17, 2003.

Brand Strategy; *The National Lottery has announced that UK consumers will be able to purchase tickets using the internet, TV and Mobile phones*. (Launches & Rebrands); ISSN 0965-9390; 1 page; Apr. 2003.

PR Newswire; *Ideaworks3D appointed by Eidos Interactive to Develop Blockbuster Line-up for Nokia N-Gage Mobile Game Deck*; 2 pages; May 23, 2003.

Telecomworldwire; *New mobile lottery service launched by mLotto*; 1 page; Oct. 30, 2003.

Singh, et al.; *Anywhere, Any-Device Gaming*; Human Interface Technology Laboratory; National University of Singapore; 4 pages; 2004.

Wu, et al; the Electronic Library; *Real Tournament—Mobile Context-Aware Gaming for the Next Generation*; vol. 22; No. 1; ISBN 0-86176-934-1; ISSN 0264-0473; 11 pages; 2004.

*Precision Marketing*; vol. 16, No. 11; ISSN 0955-0836; 2 pages; Jan. 9, 2004.

Online Reporter; *GTECH Takes Lottery Mobile*; 1 page; Feb. 28, 2004.

Personal and Ubiquitous Computing; *Human Pacman: a mobile, wide-area entertainment system based on physical, social, and ubiquitous computing*; 12 pages; May 2004.

PR Newswire; *M7 Networks Partners With Terraplay to Deliver Real-Time Multiplayer Gaming Functionality to Its Community Services Offerings*; 2 pages; Jun. 1, 2004.

China Telecom; *Win Win Gaming Inc. announces agreement to provide wireless lottery and entertainment content in Shanghai*; vol. 11, No. 9; 2 pages; Sep. 2004.

(56) References Cited

OTHER PUBLICATIONS

Business Wire; *EA Announces Next Step Into Mobile Gaming; Digital Bridges Named as Strategic. Partner for Distribution of Mobile Interactive Entertainment in Europe, North and South America*; 3 pages; Sep. 2, 2004.
Wireless News; *Mobile Casinos, Lotteries Good News for Mobile Revenues*; 2 pages; Feb. 23, 2005.
Business Wire; *MobileGamingNow, Inc. Announces the Launch of the First Ever Mobile Phone Interactive, Multi-Player Gaming System for Poker*; 2 pages; Apr. 4, 2005.
Business Wire; *InfoSpace's Golf Club 3D Scores Hole-in-One for Exciting and Realistic Game Play; InfoSpace's 3D Golf Captures the Challenge and Realism of the Sport With Real-Time 3D Animation, Weather Effects, and Customizable Characters*; 2 pages; Apr. 21, 2005.
Business Wire; *July Systems' Play2Win Interactive Game Service Launched on UK's MobileGaming.com; Speedy Customer Deployments Now Possible With July's New UK Mobile Retailing Infrastructure*; 2 pages; May 4, 2005.
Gaming Labs Certified™; Standard Series; *GLI-26: Wireless Gaming System Standards*; Version: 1.1; 28 pages; Jan. 18, 2007.
Notification of Transmittal of the International Search Report and the Written Opinion of the International Searching Authority, or the Declaration, for International Application No. PCT/US06/26343, 8 pages, dated Jan. 19, 2007.
Notification of Transmittal of the International Search Report and the Written Opinion of the International Searching Authority, or the Declaration, for International Application No. PCT/US06/26600, 8 pages, dated Jan. 19, 2007.
Notification of Transmittal of the International Search Report and the Written Opinion of the International Searching Authority, or the Declaration for International Application No. PCT/US06/26346, 8 pages, dated Mar. 29, 2007.
Notification of Transmittal of the International Search Report and the Written Opinion of the International Searching Authority, or the Declaration for International Application No. PCT/US05/05905, 10 pages, dated Apr. 10, 2007.
Gaming Labs Certified™; Standard Series; *GLI-11: Gaming Devices in Casinos*; Version: 2.0; 96 pages; Apr. 20, 2007.
Notification of Transmittal of the International Search Report and the Written Opinion of the International Searching Authority, or the Declaration for International Application No. PCT/US06/26350, 8 pages, dated Apr. 27, 2007.
Gaming Labs Certified™; Standard Series; *GLI-21: Client-Server Systems*; Version: 2.1; 85 pages; May 18, 2007.
USPTO Office Action for U.S. Appl. No. 11/418,939, dated Dec. 17, 2007 (13 pages).
USPTO Office Action for U.S. Appl. No. 11/418,939, dated Aug. 20, 2008 (12 pages).
USPTO Office Action for U.S. Appl. No. 11/418,939, dated Apr. 10, 2007.
United States Patent and Trademark Office, Office Action for U.S. Appl. No. 11/210,482; 26 pages; dated Jul. 27, 2007.
Australian Patent Office; Examination Report for Singapore Patent Application No. 0605830-9; 5 pages; dated Jul. 7, 2008.
PCT Notification of Transmittal of the International Search Report and the Written Opinion of the International Searching Authority for International Application No. PCT/US07/66873; 4 pages; dated Aug. 4, 2008.
PCT Notification of Transmittal of the International Search Report and the Written Opinion of the International Searching Authority for International Application No. PCT/US2008/057239; 8 pages; dated Aug. 7, 2008.
U.S. PTO Office Action for U.S. Appl. No. 11/199,831; 9 pages; dated Dec. 19, 2008.
U.S. PTO Office Action for U.S. Appl. No. 10/835,995; 11 pages; dated Jan. 22, 2009.
U.S. PTO Office Action for U.S. Appl. No. 11/406,783; dated Feb. 9, 2009.
Australian Examination Report for AU Application 2006269418; 2 pages; dated Mar. 12, 2009.
U.S. PTO Office Action for U.S. Appl. No. 11/063,311; 14 pages; dated Apr. 29, 2009.
U.S. PTO Office Action for U.S. Appl. No. 10/897,822; 7 pages; dated Jan. 23, 2009.
U.S. PTO Office Action for U.S. Appl. No. 10/897,822; 7 pages; dated Jul. 16, 2008.
U.S. PTO Office Action for U.S. Appl. No. 10/897,822; 14 pages; dated Aug. 31, 2007.
U.S. PTO Office Action for U.S. Appl. No. 10/897,822; 16 pages; dated Feb. 22, 2007.
U.S. PTO Office Action for U.S. Appl. No. 10/897,822; 17 pages; dated Aug. 5, 2009.
U.S. PTO Office Action for U.S. Appl. No. 10/897,822; 7 pages; dated Feb. 6, 2008.
Applicants Summary of Interview with Examiner dated 6/13/7 for U.S. Appl. No. 10/897,822; 2 pages.
EPO Examination Report for EP Application No. 05775503.5-1238 dated Jul. 23, 2007; 5; 5 pages.
PCT International Search Report and Written Opinion for International Application No. PCT/US2005/025722; dated May 11, 2002; 11 pages.
Canadian Examination Report for CA Application No. 2613338; 4 pages; dated Oct. 5, 2009.
International Search Report for International Application No. PCT/US07/84669; 2 pages; dated Jun. 6, 2008;.
U.S. PTO Office Action for U.S. Appl. No. 11/557,131; 7 pages; 9/29/9.
U.S. PTO Office Action for U.S. Appl. No. 11/557,125; 10 pages; dated Nov. 9, 2009.
Office Action for Japanese Patent Application No. 2007-500972; dated Feb. 23, 2010; 3 pages; with translation 3 pages.
Office Action for Japanese Patent Application No. 2007-556420; dated Feb. 23, 2010; 4 pages; with translation 4 pages.
U.S. PTO Office Action for U.S. Appl. No. 10/897,822; 14 pages; dated Feb. 4, 2010.
Applicants Response, Claims, Arguments and Remarks dated Dec. 7, 2009 for U.S. Appl. No. 10/897,822; 18 pages.
AU Examination Report for Au Application No. 2006269418; 2 pages; dated Oct. 27, 2009.
U.S. PTO Office Action for U.S. Appl. No. 10/835,995; 11 pages; dated Jul. 12, 2010.
U.S. PTO Office Action for U.S. Appl. No. 10/395,963; 22 pages; dated Jul. 2, 2010.
U.S. PTO Office Action for U.S. Appl. No. 10/395,963; 26 pages; dated Dec. 18, 2009.
U.S. PTO Office Action for U.S. Appl. No. 10/395,963; 18 pages; dated Jun. 9, 2009.
U.S. PTO Office Action for U.S. Appl. No. 10/395,963; 16 pages; dated Jan. 21, 2009.
U.S. PTO Office Action for U.S. Appl. No. 10/395,963; 11 pages; dated Jul. 21, 2008.
U.S. PTO Office Action for U.S. Appl. No. 10/395,963; 3 pages; dated Mar. 10, 2008.
U.S. PTO Office Action for U.S. Appl. No. 10/395,963; 13 pages; dated Jan. 8, 2008.
Applicants Response, Claims, Arguments and Remarks dated Oct. 31, 2007 for U.S. Appl. No. 10/395,963; 14 pages.
U.S. PTO Office Action for U.S. Appl. No. 10/395,963; 12 pages; dated Sep. 19, 2007.
U.S. PTO Office Action for U.S. Appl. No. 10/395,963; 12 pages; dated Mar. 29, 2007.
U.S. PTO Office Action for U.S. Appl. No. 10/395,963; 7 pages; dated May 8, 2006.
U.S. PTO Office Action for U.S. Appl. No. 10/395,988 ; dated Jan. 9, 2007; 7 pages.
U.S. PTO Office Action for U.S. Appl. No. 10/395,988 ; dated Aug. 17, 2007; 4 pages.
U.S. PTO Office Action for U.S. Appl. No. 12/367,566; dated Jul. 20, 2010; 8 pages.
U.S. PTO Office Action for U.S. Appl. No. 10/395,988 ; dated Apr. 28, 2010; 9 pages.

(56) References Cited

OTHER PUBLICATIONS

Advisory Action for U.S. Appl. No. 10/395,963; 4 pages; dated May 4, 2009.
Advisory Action for U.S. Appl. No. 10/395,963; 3 pages; dated Apr. 8, 2008.
Examiner Interview Summary Record for U.S. Appl. No. 10/395,963; 5 pages; dated Apr. 7, 2008.
Miscellaneous Communication to Applicant for U.S. Appl. No. 10/395,963; 2 pages; dated Oct. 11, 2006.
Advisory Action for U.S. Appl. No. 10/395,963; 4 pages; dated Sep. 17, 2009.
Examiner Interview Summary Record for U.S. Appl. No. 10/897,822; 4 pages; dated Jun. 13, 2007.
Au Examination Report for AU Application No. 2006216723; 2 pages; dated Jul. 1, 2010.
U.S. PTO Office Action for U.S. Appl. No. 11/839,412; dated Jan. 20, 2011; 20 pages.
U.S. PTO Office Action for U.S. Appl. No. 11/839,404; dated Jan. 19, 2011; 19 pages.
Notice of Allowance for U.S. Appl. No. 11/557,125; 7 pages; dated Jan. 21, 2011.
U.S. PTO Office Action for U.S. Appl. No. 11/839,418; 15 pages; dated Feb. 10, 2011.
JP Office Action for Application No. 2008-520393; dated Jan. 24, 2011; 8 pages total with English Translation.
U.S. PTO Office Action for U.S. Appl. No. 11/839,425; dated Mar. 3, 2011; 64 pages.
U.S. PTO Office Action for U.S. Appl. No. 10/835995; 52 pages; dated Mar. 15, 2011.
Chinese Office Action for Application No. 200580009075.5 dated Oct. 26, 2010; 7 pages.
Chinese Office Action for Application No. 200580009075.5 dated Sep. 25, 2009; 10 pages.
Notice of Allowance for U.S. Appl. No. 11/557,125; 15 pages; dated May 27, 2011.
U.S. PTO Office Action for U.S. Appl. No. 12/197,809; dated May 25, 2011; 35 pages.
Notice of Acceptance for AU Application No. 2006269418 dated Apr. 8, 2010; 3 pages.
U.S. PTO Office Action for U.S. Appl. No. 11/063,311; 11 pages; dated May 12, 2011.
Examiners second Report for AU Application No. 2010212329; 2 pages; dated Aug. 16, 2011.
Examination Report for AU Application No. 2010202517; 2 pages; dated Jun. 23, 2011.
JP Office Action for Application No. 2008-520393; dated Aug. 16, 2011; 16 pages total with English Translation.
Chinese Office Action for Application No. 200580009075.5; dated Aug. 3, 2011; 8 pages.
U.S. PTO Office Action for U.S. Appl. No. 11/839,412; 24 pages; dated Sep. 7, 2011.
Notice of Allowance for U.S. Appl. No. 10/835,995; 11 pages; dated Sep. 2, 2011.
U.S. PTO Office Action for U.S. Appl. No. 10/897,822; 14 pages; dated Sep. 28, 2010.
U.S. PTO Office Action for U.S. Appl. No. 10/897,822; 15 pages; dated Jan. 12, 2011.
Notice of Allowance for U.S. Appl. No. 10/897,822; 7 pages; dated Jun. 7, 2011.
U.S. PTO Office Action for U.S. Appl. No. 10/395,963; 25 pages; dated Jun. 29, 2011.
Notice of Allowance dated Sep. 20, 2010 for U.S. Appl. No. 10/395,988 ; 4 pages.
Canadian Examination Report for CA Application No. 2613338; 4 pages; dated Aug. 16, 2011.
U.S. PTO Office Action for U.S. Appl. No. 11/839,425; dated Sep. 26, 2011; 10 pages.
Notice of Allowance for U.S. Appl. No. 11/557,125; dated Nov. 16, 2011; 10 pages.
Notice of Allowance for U.S. Appl. No. 11/839,404; dated Nov. 3, 2011; 56 pages.
U.S. PTO Office Action for U.S. Appl. No. 11/839,418; 28 pages; dated Nov. 9, 2011.
Notice of Allowance for U.S. Appl. No. 11/839,418; dated Jan. 27, 2012; 8 pages.
Examination Report for CA Application No. 2557209 dated Jan. 20, 2012; 6 pages.
Examination Report for CA Application No. 2598041 dated Jan. 27, 2012; 6 pages.
U.S. PTO Office Action for U.S. Appl. No. 12/197,809; dated Feb. 10, 2012; 19 pages.
U.S. PTO Office Action for U.S. Appl. No. 11/063,311; 8 pages; dated Jan. 13, 2012.
JP Office Action for Application No. 2007-500972; dated Jan. 24, 2012; 4 pages (includes English Translation).
Notice of Allowance for U.S. Appl. No. 11/839,404; dated Mar. 5, 2012; 9 pages.
Notice of Allowance for U.S. Appl. No. 11/839,418; dated Mar. 14, 2012; 9 pages.
Notice of Panel Decision for U.S. Appl. No. 11/839,425; dated Mar. 28, 2012; 2 pages.
AU Examination report for Application No. 2011244922; dated Jun. 12, 2012; 2 pages.
Notice of Allowance for U.S. Appl. No. 11/839,418; dated Jul. 2, 2012; 10 pages.
JP Office Action for Application No. 2008-520393; dated Jul. 3, 2012; 4 pages total with English Translation.
U.S. Office Action for U.S. Appl. No. 13/561,279; dated Oct. 11, 2012; 11 pages.
U.S. Office Action for U.S. Appl. No. 13/561,299; dated Oct. 10, 2012; 11 pages.
AU Examiners Report for Application No. 2005216239 dated Nov. 18, 2009; 2 pages.
Chinese Office Action for Application No. 200580009075.5; dated Jun. 5, 2012; 9 pages.
European Extended Search Report for Application No. 05723674.7; dated Dec. 7, 2011; 6 pages.
U.S. PTO Office Action for U.S. Appl. No. 11/839,412; 17 pages; dated Oct. 19, 2012.
AU Notice of Acceptance for Au Application No. 2006216723; 3 pages; dated Mar. 20, 2012.
European Extended Search Report for Application No. 06735821.8; dated Dec. 7, 2011; 9 pages.
Office Action for Japanese Patent Application No. 2010-186542 ; dated May 22, 2012; 6 pages.
U.S. Notice of Allowance for U.S. Appl. No. 12/197,809; dated Nov. 15, 2012; 15 pages.
Examination Report for AU Application No. 2010202517; 2 pages; dated Aug. 16, 2011.
European Extended Search Report for Application No. 06786488.4; dated May 14m 2012; 6 pages.
Yampolskiy et al., 2006, "Use of Behavioral Biometrics in Intrusion detection and Online Gaming", Biometric technology for Human Identification III, edited by Patrick J. Flynn, Sharath Pankanti, Proc. Of SPIE vol. 6202, 62020U-1-10.
U.S. PTO Office Action for U.S. Appl. No. 11/839,425; 11 pages; dated Jan. 24, 2013.
Office Action for Japanese Patent Application No. 2010-186542 ; dated Jan. 8, 2013; 5 pages.
U.S. PTO Office Action for U.S. Appl. No. 13/346,133; 24 pages; dated Oct. 10, 2012.
U.S. Office Action for U.S. Appl. No. 13/561,335; dated Dec. 28, 2012; 10 pages.
U.S. Office Action for U.S. Appl. No. 13/616,268; dated Dec. 20, 2012; 7 pages.
European Communication for Application No. 05723674.7; dated Sep. 12, 2012; 5 pages.
Notice of Allowance for U.S. Appl. No. 11/557,125; 31 pages; dated Jan. 2, 2013.
Notice of Allowance for U.S. Appl. No. 12/194,809; 27 pages; dated Mar. 6, 2013.

(56) References Cited

OTHER PUBLICATIONS

AU Notice of Acceptance for Au Application No. 2010202517; 2 pages; dated Mar. 18, 2013.
Notice of Allowance for U.S. Appl. No. 11/063,311, 8 pages; dated Apr. 8, 2013.
U.S. Office Action for U.S. Appl. No. 13/561,274; 13 pages; dated May 10, 2013.
Notice of Allowance for U.S. Appl. No. 11/063,311, 6 pages; dated May 23, 2013.
U.S. Final Office Action for U.S. Appl. No. 13/561,299; 13 pages; dated Jun. 7, 2013.
CN Notice of Reexamination for Application No. 200580009075.5; 6 pages; dated May 24, 2013 (w/ English translation).
U.S. Office Action for U.S. Appl. No. 13/561,335; dated Jun. 21, 2013; 13 pages.
European Extended Search Report for Application No. 06735821.8; dated Jan. 17, 2013; 5 pages.
U.S. Final Office Action for U.S. Appl. No. 13/346,133; 13 pages; dated Aug. 12, 2013.
U.S. Final Office Action for U.S. Appl. No. 13/616,268; 13; pages; dated Aug. 15, 2013.
U.S. Final Office Action for U.S. Appl. No. 11/839,425; 11; pages; dated Aug. 15, 2013.
Australian Examination Report for AU Application No. 2012203722, 2 pages; dated Aug. 23, 2013.
U.S. Notice of Allowance for U.S. Appl. No. 11/063,311; dated Sep. 10, 2013; 7 pages.
JP Final Decision for Appeal No. 2012-9549; dated Sep. 10, 2013; 26 Pages (w/English translation).
JP Decision on Appeal for Application No. 2005-520393; dated Sep. 10, 2013; 45 pages (w/English translation).
CN Reexamination Decision for Application No. 200580009075.5; dated Dec. 5, 2013; 7 pages (w/English translation).
U.S. Notice of Allowance for U.S. Appl. No. 11/557,125; dated Nov. 26, 2013; 7 pages.
U.S. Office Action for U.S. Appl. No. 11/839,412; dated Jan. 10, 2014; 18 pages.
JP Office Action for App. No. 2012-117867; 5 pages; dated Jan. 7, 2014 (w/English translation).
EP Office Action for Application No. 06786488.4; dated Jan. 27, 2014; 7 pages.
Bahl and Padmanabhan, 2000, "RADAR: An In-Building RF-based User Location and Tracking System", Microsoft Research, p. 775-784.
CN Office Action for App. No. 200580009075.5; dated Mar. 26, 2014; 6 pages.
JP Office Action for App. No. 2012-208520; dated Mar. 18, 2014; 6 pages (w/English translation).
CA Examiner's Requisition for Application No. 2,557,209; dated Jun. 25, 2014; 2 pages.
CA Examiner's Requisition for App. No. 2,598,041; dated Jul. 17, 2014; 2 pages.
CN Office Action for App. No. 200580009075.5; dated Nov. 15, 2014; 5 pages.
AU Examination Report No. 1 for App. No. 2013201174; dated Feb. 4, 2015; 5 pages.
CA Examiners Requisition for App. No. 2,557,209; dated Mar. 31, 2015; 4 pages.
CN Office Action for App No. 200580009075.5; dated May 14, 2015; 4 pages (w/English translation).
JP Office Action for App. No. 2012-117867; dated Apr. 21, 2015; 6 pages (w/English translation).
JP Final Decision for App. No. 2012-208520; dated Apr. 21, 2015; 9 pages (w/English translation).
EP Summons to Attend Oral Hearings for App. No. 08723674.7; dated Jul. 10, 2015; 6 pages.
CA Examiner's Requisition for App. No. 2,598,041; dated Jul. 28, 2015; 4 pages.
AU Patent Examination Report No. 1 for App. No. 2014201396; dated Sep. 15, 2015; 3 pages.
"Probability, Odds, and Random Chance", Problem Gambling Institute of Ontario, retrieved from Internet on Jan. 27, 2014 <http://www.problemgambling.ca/en/resourcesforprofessionals/pages/probabilityoddsandrandomchance.aspx>.
"Changing Probability to Odds", Math Magic, retrieved from Internet on Jan. 27, 2014 <http://www.math-magic.com/probability/prob_to_odds.htm>.
"Craps From Wikipedia, the free encyclopedia", Wikipedia, retrieved from Internet on Jan. 27, 2014 <http://en.wikipedia.org/wiki/Craps#Bet_odds_and_summary>.
Defendants' Joint Unenforceability and Invalidity Contentions dated Mar. 21, 2017 (51 pages).
IPR Decision for U.S. Pat. No. 9,306,952, Case IPR2017-01333, Nov. 13, 2017 (30 pages).
Patent Owner's Preliminary Response for U.S. Pat. No. 9,306,952, Case IPR2017-01333, Aug. 16, 2017 (49 pages).
Petition for Inter Partes Review of U.S. Pat. No. 9,306,952, Case IPR2017-01333, May 1, 2017 (74 pages).
IPR Decision for U.S. Pat. No. 9,355,518, Case IPR2017-01532, Dec. 13, 2017 (29 pages).
Patent Owner's Preliminary Response for U.S. Pat. No. 9,355,518, Case IPR2017-01532, Sep. 19, 2017 (27 pages).
Petition for Inter Partes Review of U.S. Pat. No. 9,355,518, Case IPR2017-01532, Jun. 8, 2017 (74 pages).
ImagiNation—OnLine Games, 1995, 58 pages.
ImagiNation, 1993 ImagiNation Network—A Quick Guide to Using Your Imagination, 16 pages.
ImagiNation Network [R] General Documentation (INN), 27 pages.
Byte Magazine, Mar. 1984, vol. 9, No. 3 (552 pages).
IBM Technical Reference, 1st Ed. Revised, Nov. 1983 (572 pages).
IBM PC Jr. Advertising Booklet, 1983, 14 pages.
IBM PC Jr. Order Form, Nov. 1983, 2 pages.
Sierra 3-D Animated Adventure Game Reference Card for MS DOS, 1987 (4 pages).
Leisure Suit Larry in the Land of the Lounge Lizards Manual, Jun. 4, 1987, 13 pages.
Electronic Gaming Monthly, No. 89, Dec., 1996 (352 pages).
Wireless Pro Fighter 8 Box Cover (1 page), Dec. 1996.
Naki Wireless Pro Fighter 8 controller (1 page), Dec. 1996.
Sega Saturn Instruction Manual (24 pages), May 11, 1995.
Sega Saturn Overview Manual (67 pages), Jun. 27, 1995.
Sega Saturn Introduction Manual (10 pages), Jun. 27, 1995.
Game FAQs: Tokimeki Memorial: Forever With You, Dec. 13, 1996 (17 pages).
How to get the most out of CompuServe, Charles Bowen and David Peyton, 1986 (58 pages).
Alfred Glossbrenner's Master Guide to Compuserve, 1987 (25 pages).
CompuServe Information Service Users Guide, Sep. 1986 (42 pages).
The Official Guide to the Prodigy Service, John L. Vierscas, 1998 (77 pages).
Wireless Gaming Makes Strides in Nevada by Libe Goad, PCMag.com, Jun. 9, 2005 (3 pages).
Guinn gives OK to wireless gaming devices in casinos by Elizabeth White, Las Vegas Sun, Jun. 2, 2005 (8 pages).
Welcome to Cantor Casino, Wayback machine, Oct. 2005 (1 page).
Hand-held devices next wave in gaming, the Times, Aug. 12, 2005 (1 page).
Rolling the dice, Casinos ready to put their money on wireless gaming devices, The Journal News, Nov. 14, 2005 (2 pages).
Nevada Oks gambling on the go, the Courier Journal, Apr. 2, 2006 (1 page).
Devices could bring mobile gaming to casinos, Reno Gazette-Journal, Mar. 24, 2006 (2 pages).
Regulators approve wireless device by Ryan Randazzo, Reno Gazette Journal, Aug. 25, 2006.
Nevada Gaming Commission Mobile Gaming Policies, May 18, 2006 (5 pages).
Handheld gambling devices will show up soon in casinos by the Associated Press in the Florida Today Newspaper Aug. 3, 2005 (1 page).

(56) References Cited

OTHER PUBLICATIONS

Cantor Fitzgerald Press Release—Cantor Fitzgerald Launches Cantor Casino and Cantor Gaming, Sep. 29, 2005 (2 pages).
Coming to a Nevada casino soon: Playing the slots wirelessly, by the New York Times in the Arizona Republic Newspaper—Fox Butterfield, Jul. 4, 2005 (1 page).
Minutes of the Meeting on the Assembly Committee on Judiciary, Seventy-Third Session, Apr. 8, 2005 (42 pages).
O2 and Cantor Index bring gambling to PDAs by Jo Best of ZDNet, Sep. 3, 2003 (6 pages).
Stocking fillers by Ashley Norton of the Guardian, Sep. 20, 2003 (5 pages).
O2 XDA II Coming November By Fabrizio Pilato of Mobile Mag, Oct. 23, 2003 (6 pages).
Securities and Exchange Commission—The XDA II from O2 Corners a Third of the Market in First Six Months Jul. 15, 2004 (3 pages).
Final Notice to Cantor Index Limited from the Financial Services Authority, Dec. 30, 2004 (13 pages).
Handheld devices can be used for games in Casino public areas by the Associated Press in NBC News, Mar. 24, 2006 (2 pages).
Nevada approves new mobile gambling rules, GMA News Online, Mar. 24, 2006 (5 pages).
Legalized Gambling as a Strategy for Economic Development by Robert Goodman Mar. 1994 (225 pages.
New York Times—Two inventors contend that the V-chip is an idea they've seen before—in their own patent.—by Teresa Riordan Oct. 28, 1996 (4 pages).
Wireless ATM & Ad-Hoc Networks by C-K Toh, Dec. 31, 1996 (23 pages).
PC Mag—Wireless Gaming Makes Strides in Nevada, Jun. 9, 2005 (3 pages).
The Times Money, Hanld-held devices next wave in gaming, Aug. 12, 2005 (1 page).
AOL—The Official America Online Tour Guide for Windows 3.1, 1996 Tom Lichty, Jul., 1996 (14 pages).
Business Wire—Diamond I Opens Online Interactive Demo of its WifiCasino GS Gaming System, Apr. 27, 2005 (3 pages).
Diamond I PRN Wire Diamond I Comments on Future of Hand-held Gambling Devices in Nevada, Jun. 2, 2005 (4 pages).
Diamond I Rolls the Dice by Naomi Graychase, Feb. 23, 2005 (3 pages).
Diamond I Opens Online Interactive Demo of its WifiCasino GS Gaming System, Business Wire, Apr. 27, 2005 (3 pages).
Diamond I Responds to Inquiries: What is "WifiCasino GS"?, Business Wire, Jan. 27, 2005 (3 pages).
Diamond I Technologies—Products, Wayback Machine, Apr. 29, 2005-Aug. 12, 2007, (2 pages).
Diamond I Technologies—Products, Wayback Machine, Apr. 29, 2005-Jan. 6, 2010, (2 pages).
Kidnet, Kid's Guide to Surfing through Cyberspace by Brad and Debra Schepp—Nov. 1995 (9 pages).
The New York Times—Nintendo and Minnesota Set a Living-Room Lottery. Test, Sep. 27, 1991, (4 pages).
The New York Times—Minnesota Cancels Plan to Play Lottery on Nintendo, Oct. 19, 1991 (3 pages).
Case 2:16-cv-00856-RCJ-VCF, Document 1, "Plaintiffs' Complaint for Patent Infringement" filed Apr. 14, 2016 (39 pages).
Case 2:16-cv-00856-RCJ-VCF, Document 19, "Plaintiffs' First Amended Complaint for Patent Infringement", filed Jul. 11, 2016 (57 pages).
Case 2:16-cv-00856-RCJ-VCF, Document 23, "Defendant 888's Motion to Dismiss Plaintiffs First Amended Complaint Under Fed. R. Civ. P. 12(B)(6)", filed Aug. 12, 2016 (22 pages).
Case 2:16-cv-00856-RCJ-VCF, Document 26, "Defendant's Notice of Joinder to Motions to Dismiss in Related Cases", filed Aug. 12, 2016 (4 pages).
Case 2:16-cv-00856-RCJ-VCF, Document 36, "Plaintiffs' Opposition to 888 Holdings PLC's Motion to. Dismiss", filed Sep. 8, 2016 (32 pages).
Case 2:16-cv-00856-RCJ-VCF, Document 37, "Index of Exhibits to Plaintiffs' Opposition to Defendant's Motion to Dismiss" filed Sep. 8, 2016 (3 pages).
Case 2:16-cv-00856-RCJ-VCF, Document 45, Defendant 888's Reply in Support to Dismiss Plaintiffs' First Amended Complaint Under Fed. R. Civ. P. 12(B)(6), filed Sep. 26, 2016 (19 pages).
Case 2:16-cv-00856-RCJ-VCF, Document 46, Defendant 888's Reply in Support of Motion to Dismiss Plaintiffs' First Amended Complaint Under Fed. R. Civ. P. 12(B)(6), filed Sep. 26, 2016.
Case 2:16-cv-00856-RCJ-VCF, Document 54, "Order", filed Dec. 6, 2016 (8 pages).
Case 2:16-cv-00856-RCJ-VCF, Document 57, "Defendant 888's Holdings PLC's Answer to Plaintiffs'First Amended Complaint", filed Jan. 18, 2017 (67 pages).
Case 2:16-cv-00857-APG-VCF, Document 1, "Plaintiffs' Complaint for Patent Infringement" filed Apr. 2016 (29 pages).
Case 2:16-cv-00857-RCJ-VCF, Document 27, "Defendant Big Fish Games, Inc.'s Motion to Dismiss", filed Jun. 17, 2016 (30 pages).
Case 2:16-cv-00857-RCJ-VCF, Document 32, "[Corrected] Defendant Big Fish Games, Inc.'s Motion to Dismiss", filed Jul. 8, 2016 (30 pages).
Case 2:16-cv-00857-RCJ-VCF, Document 33, "Plaintiffs' Opposition to Big Fish Games, Inc.'s Motion to Dismiss", filed Jul. 25, 2016 (32 pages).
Case 2:16-cv-00857-RCJ-VCF, Document 34, "Reply in Support of Defendant Big Fish Games, Inc.'s Motion to Dismiss", filed Aug. 4, 2016 (17 pages).
Case 2:16-cv-00857-RCJ-VCF, Document 36, "Order" filed Aug. 29, 2016 (29 pages).
Case 2:16-cv-00857-RCJ-VCF, Document 37, "Plaintiffs' First Amended Complaint for Patent Infringement", filed Sep. 28, 2016 (38 pages).
Case 2:16-cv-00857-RCJ-VCF, Document 39, "Defendant Big Fish Games, Inc.'s Motion to Dismiss Plaintiffs' First Amended Complaint", filed Oct. 12, 2016 (17 pages).
Case 2:16-cv-00857-RCJ-VCF, Document 45, "Plaintiffs' Opposition to Big Fish Games, Inc.'s Motion to Dismiss", filed Oct. 31, 2016 (22 pages).
Case 2:16-cv-00857-RCJ-VCF, Document 49, "Reply in Support of Defendant Big Fish Games, Inc.'s Motion to Dismiss", filed Nov. 10, 2016 (16 pages).
Case 2:16-cv-00857-RCJ-VCF, Document 59, "Order", filed Jan. 4, 2017 (9 pages).
Case 2:16-cv-00857-RCJ-VCF, Document 60, "Defendant Big Fish Games, Inc.'s Answer to First Amended Complaint", filed Jan. 19, 2017 (17 pages).
Case 2:16-cv-00871-JAD-VCF, Document 1, "Plaintiffs' Complaint for Patent Infringement" filed Apr. 2016 (39 pages).
Case 2:16-cv-00871-JAD-VCF, Document 23, "Plaintiffs' First Amended Complaint for Patent Infringement" filed Jul. 11, 2016 (57 pages).
Case 2:16-cv-00871-JAD-VCF, Document 31, "Motion to Dismiss Under 35 U.S.C. §101" filed Aug. 12, 2016 (16 pages).
Case 2:16-cv-00871-RCJ-VCF, Document 35, "Plaintiffs' Opposition to Defendants' Motion to Dismiss" filed Sep. 8, 2016 (25 pages).
Case 2:16-cv-00871-RCJ-VCF, Document 40, "Reply in Support of Motion to Dismiss Under 35 U.S.C. §101" filed Sep. 26, 2016 (14 pages).
Case 2:16-cv-00871-RCJ-VCF, Document 42, "Order" filed Oct. 18, 2016 (15 pages).
Case 2:16-cv-00871-RCJ-VCF, Document 46, "Motion for Reconsideration" filed Oct. 31, 2016 (7 pages).
Case 2:16-cv-00871-RCJ-VCF, Document 47, Motion to Dismiss Under Fed. R. Civ. P. 12(B)(6) filed Nov. 1, 2016 (7 pages).
Case 2:16-cv-00871-RCJ-VCF, Document 49, "Plaintiffs' Opposition to Defendants' Motion for Reconsideration", filed Nov. 17, 2016 (11 pages).
Case 2:16-cv-00871-RCJ-VCF, Document 50, "Plaintiffs' Opposition to Defendants' Motion to Dismiss", filed Nov. 17, 2016 (12 pages).

(56) References Cited

OTHER PUBLICATIONS

Case 2:16-cv-00871-RCJ-VCF, Document 55, Reply in Support of Defendants' Motion to Dismiss Under Fed. R. Civ. P. 12(B)(6), filed Nov. 30, 2016 (6 pages).
Case 2:16-cv-00871-RCJ-VCF, Document 56, "Reply in Support of Motion for Reconsideration" filed Nov. 30, 2016 (7 pages).
Case 2:16-cv-00871-RCJ-VCF, Document 63, "Order" filed Jan. 4, 2017 (10 pages).
Case 2:16-cv-00871-RCJ-VCF, Document 64, "Bwin's Answer to Plaintiffs' First Amended Complaint" filed Jan. 6, 2017 (15 pages).
Case 2:16-cv-00858-MMD-GWF, Document 1, "Plaintiffs' Complaint for Patent Infringement" filed Apr. 14, 2016 (30 pages).
Case 2:16-cv-00858-RCJ-VCF, Document 19, "Defendant Double Down Interactive LLC's Motion to Dismiss", filed Jun. 7, 2016 (32 pages).
Case 2:16-cv-00858-RCJ-VCF, Document 30, "Plaintiffs' Opposition to Double Down's Motion to Dismiss", filed Jul. 8, 2016 (31 pages).
Case 2:16-cv-00858-RCJ-VCF, Document 51, "Reply in Support of Defendant Double Down Interactive Llc's Motion to Dismiss", filed Jul. 18, 2016 (14 pages).
Case 2:16-cv-00858-RCJ-VCF, Document 58, "Plaintiffs' First Amended Complaint for Patent Infringement", filed Sep. 28, 2016 (38 pages).
Case 2:16-cv-00858-RCJ-VCF, Document 63, "Defendant Double Down Interactive LLC's Motion to Dismiss Plaintiffs' First Amended Complaint for Patent Infringement", Oct. 17, 2016 (31 pages).
Case 2:16-cv-00858-RCJ-VCF, Document 69, "Plaintiffs' Opposition to Double Down Interactive, Inc.'s Motion to Dismiss", filed Nov. 3, 2016 (24 pages).
Case 2:16-cv-00858-RCJ-VCF, Document 76, "Defendant Double Down Interactive LLC's Reply in Support of Motion to Dismiss Plaintiffs' First Amended Complaint for Patent Infringement", filed Nov. 14, 2016 (18 pages).
Case 2:16-cv-00858-RCJ-VCF, Document 83, "Defendant Double Down Interactive Llc's Answer, Defenses, and Counterclaims to Plaintiffs' First Amended Complaint for Patent Infringement", filed Jan. 18, 2017 (19 pages).
Case 2:16-cv-00858-RCJ-VCF, Document 84, "Plaintiffs' Answer to Double Down Interactive LLC's Counterclaims Against CG Technology Development, LLC", filed Feb. 8, 2017 (4 pages).
Case 2:16-cv-00781-RFB-CWH, Document 1, "Plaintiffs' Complaint for Patent Infringement" filed Apr. 7, 2016 (33 pages).
Case 2:16-cv-00781-MMD-CWH, Document 29, "Plaintiffs' First Amended Complaint for Patent Infringement" filed Jun. 13, 2016 (42 pages).
Case 2:16-cv-00781-MMD-CWH, Document 37, "Defendant's Motion to Dismiss Plaintiffs' Amended Complaint Under Fed.R. Civ. P. 12(B)(6)" filed Jul. 29, 2016 (38 pages).
Case 2:16-cv-00781-MMD-CWH, Document 44, "Defendant's Motion for Protective Order Staying Discovery Pending Ruling on Motion to Dismiss" filed Aug. 22, 2016 (12 pages).
Case 2:16-cv-00781-MMD-CWH, Document 45, "Plaintiffs' Opposition to DraftKings, Inc.'s Motion to Dismiss" filed Aug. 24, 2016 (38 pages).
Case 2:16-cv-00781-MMD-CWH, Document 50, "Plaintiffs' Opposition to DraftKings, Inc.'s Motion to Stay" filed Sep. 8, 2016 (12 pages).
Case 2:16-cv-00781-MMD-CWH, Document 57, "Defendant's Reply in Support of it's Motion to Dismiss Plaintiffs' Amended Complaint Under Fed. R. Civ. P. 12(B)(6)" filed Sep. 26, 2016 (19 pages).
Case 2:16-cv-00781-MMD-CWH, Document 59, "Order" filed Sep. 27, 2016 (3 pages).
Case 2:16-cv-00781-RCJ-VCF, Document 64, "Plaintiffs" Motion to Lift Stay" filed Nov. 23, 2016 (6 pages).
Case 2:16-cv-00781-RCJ-VCF, Document 69, "Order" filed Dec. 12, 2016 (11 pages).
Case 2:16-cv-00781-RCJ-VCF, Document 72, "DraftKings' Answer to Plaintiffs' First Amended Complaint and Affirmative Defenses" filed Dec. 27, 2016 (29 pages).
Case 2:16-cv-00801-JCM-VCF, Document 1, "Plaintiffs' Complaint for Patent Infringement" filed Apr. 8, 2016 (31 pages).
Case 2:16-cv-00801-RCJ-VCF, Document 31, "Plaintiffs' First Amended Complaint for Patent Infringement" filed Jun. 13, 2016 (48 pages).
Case 2:16-cv-00801-RCJ-VCF, Document 32, "Index of Exhibits to Plaintiffs' First Amended Complaint for Patent Infringement" filed Jun. 13, 2016 (3 pages).
Case 2:16-cv-00801-Rcj-Vcf Document 44, "Defendant Fanduel, Inc's Motion to Dismiss for Failure to State a Claim Upon Which Relief Can be Granted" filed Jul. 14, 2016 (18 pages).
Case 2:16-cv-00801-RCJ-VCF Document 75, "Defendant Fanduel, Inc's Motion for Leave to Supplement Briefing Under LR 7-2(g)" filed Sep. 22, 2016 (3 pages).
Case 2:16-cv-00801-RCJ-VCF Document 77, "Plaintiffs' Opposition to Defendant Fanduel, Inc.'s Motion for Leave [Ecf No. 75]" filed Oct. 11, 2016 (4 pages).
Case 2:16-cv-00801-RCJ-VCF Document 81, "Defendant Fanduel Inc.'s Notice of Withdrawal of Motion Seeking Leave to File Supplemental Briefing" filed Oct. 20, 2016 (3 pages).
Case 2:16-cv-00801-RCJ-VCF Document 86, "Plaintiffs' Second Amended Complaint For Patent Infringement" filed Nov. 16, 2016 (70 pages).
Case 2:16-cv-00801-RCJ-VCF Document 87, "Defendant Fanduel's Answer to Plaintiffs' Second Amended Complaint and Affirmative Defenses" filed Nov. 30, 2016 (19 pages).
Case 2:16-cv-00801-RCJ-VCF Document 88, "Defendant's Partial Motion to Dismiss CGT's Second Amended Complaint for Failure to State a Claim Upon Which Relief Can Be Granted" filed Nov. 30, 2016 (14 pages).
Case 2:16-cv-00801-RCJ-VCF Document 94, "Plaintiffs' Opposition to Fanduel, Inc.'s Partial Motion to Dismiss" filed Dec. 19, 2016 (11 pages).
Case 2:16-cv-00801-RCJ-VCF Document 103, "Fanduel, Inc.'s Reply in Support of Partial Motion to Dismiss" filed Dec. 27, 2016 (7 pages).
Case 2:16-cv-00801-RCJ-VCF Document 113, "Order" filed Jan. 4, 2017 (11 pages).
Case 2: 16-cv-801-RCJ-VCF Document 114, "Transcript of Pretrial Conference" filed Dec. 2, 2016 (54 pages).
Petitioners' Reply to Patent Owner's Response for IPR2017-01333, U.S. Pat. No. 9,306,952 dated May 1, 2018.
Patent Owner's Submission Regarding Petitioner's Waived Challenges for IPR2017-01333, U.S. Pat. No. 9,306,952, filed May 22, 2018.
Patent Owner's Response for IPR2017-01333, U.S. Pat. No. 9,306,952, filed Jan. 29, 2018.
Patent Owner's Submission Regarding Petitioner's Waived Challenges for IPR2017-01532, U.S. Pat. No. 9,355,518, filed May 22, 2018.
Patent Owner's Response for IPR2017-01532, U.S. Pat. No. 9,355,518, filed Mar. 9, 2018.
Deposition of Garry Kitchen for IPR2017-01333, U.S. Pat. No. 9,306,952 dated Jan. 17, 2018.
"Beyond"—definition Merriam-Webster Online Dictionary retrieved from Internet URL <https://www.merriam-webster.com/ dictionary/ beyond>. (Year: 2018).
Deposition of Dr. Robert Akl for IPR2017-01532, U.S. Pat. No. 9,355,518 dated Mar. 9, 2018.
Glossary of probability and statistics, Wikipedia, dated Mar. 5, 2018.
Van Nostrand's Scientific Encyclopedia, 3rd Edition, published Jan. 1958.
Congressional Research Service, "Remote Gambling: Industry Trends and Federal Policy", Jul. 2, 2014 (Year: 2014).
USPTO IPR Decision from parent U.S. Appl. No. 11/063,311, U.S. Pat. No. 8,616,967, dated Jan. 6, 2021 (44 pages).

* cited by examiner

SYSTEM AND METHOD FOR CONVENIENCE GAMING

RELATED APPLICATION

This application is a continuation of U.S. patent application Ser. No. 13/561,303 filed on Jul. 30, 2012 which is a continuation of U.S. patent application Ser. No. 13/346,133 filed on Jan. 9, 2012, which is a continuation of U.S. patent application Ser. No. 10/835,995 filed on Apr. 29, 2004 (now U.S. Pat. No. 8,092,303), which claims the priority under 35 U.S.C. § 119 of provisional application serial number 60/549,187 filed Mar. 1, 2004 and provisional application Ser. No. 60/547,507 filed Feb. 25, 2004.

TECHNICAL FIELD

The present invention relates generally to the field of gaming and, more particularly to a gaming system and method incorporating a wireless network.

BACKGROUND

On-line casinos are accessible via the Internet. These on-line casinos present a graphical representation of games, such as casino games, to a user on the screen of a computer in communication with the Internet. The user may place wagers, participate in the gaming, and win or lose money. Receipt of winnings, or payment of losses is typically handled through a credit account.

SUMMARY

Due to a variety of factors, Internet-based electronic gaming systems may have a number of undesirable aspects. For example, the Internet lacks the security necessary to ensure confidence that operation of an electronic gaming system will proceed without tampering. An operator of an Internet gaming system is prone to hacking, viruses and other shortcomings of conducting business over the Internet. Users of Internet-based systems often lack confidence that their financial transactions are secure and that their privacy will remain intact. Moreover, the use of the Internet does not provide location verification suitable to ensure that a user is within an approved gaming area.

Among other things, certain embodiments of the present invention incorporate non-Internet based technology with respect to a communications network in order to avoid the problems encountered in operating a gaming system via the Internet.

In one embodiment the present invention provides a convenience gaming system, which includes at least one server and at least one gaming communication device connected to the at least one server by a telecommunications network. The at least one gaming communication device is operable to send and receive gaming information to and from the at least one gaming server if the at least one gaming communication device meets at least one predetermined criteria.

In another embodiment, a method is provided for conducting convenience gaming activities on a gaming communication device in communication with a gaming server. The method includes presenting a user of the gaming communication device with one or more gaming activity options. The method further includes accepting a selection of a gaming activity option by the user, transmitting information associated with the selected gaming activity option between the gaming communication device and the server, determining a result associated with the user's selection, and transmitting the result to the user.

Various embodiments of the present invention may benefit from numerous advantages. It should be noted that one or more embodiments may benefit from some, none, or all of the advantages discussed below.

One advantage is that the system enables remote, wireless, mobile gaming over a secure network. Another advantage is that the system enables remote, wireless, mobile, gaming, while preventing gaming by unauthorized users and from unauthorized locations. Another advantage is the enablement of a gaming system accessible by remote, wireless, mobile users, wherein the system includes gaming communication devices used by the users and connected to a communication network, and wherein a portion of the communication network is movable.

Other advantages will be readily apparent to one having ordinary skill in the art from the following figures, descriptions, and claims.

BRIEF DESCRIPTION OF THE DRAWINGS

For a more complete understanding of the present invention and for further features and advantages, reference is now made to the following description, taken in conjunction with the accompanying drawings, in which.

DETAILED DESCRIPTION OF EMBODIMENTS OF THE INVENTION

A convenience gaming system enables participants to engage in gaming activities from remote and/or mobile locations. The possible gaming activities include gambling, such as that provided by casinos. Gambling activities may include any casino-type gambling activities including, but not limited to, slot machines, video poker, table games (e.g., craps, roulette, blackjack, pai gow poker, caribbean stud poker, baccarat, etc), the wheel of fortune game, keno, sports betting, horse racing, dog racing, jai alai, and other gambling activities. The gaming activities can also include wagering on any type of event. Events can include, for example, sporting events, such as horse or auto racing, and athletic competitions such as football, basketball, baseball, golf, etc. Events can also include such things that do not normally involve wagering. Such events may include, without limitation, political elections, entertainment industry awards, and box office performance of movies. Gaming can also include non-wagering games and events. Gaming can also include lotteries or lottery-type activities such as state and interstate lotteries. These can include all forms of number-selection lotteries, "scratch-off" lotteries, and other lottery contests. The convenience gaming system may be implemented over a communications network such as a cellular network or a private wireless and/or wireline network. Examples of the latter include WiFi and WiMax networks. In one embodiment, the convenience gaming system communications network is entirely independent of the Internet. In another embodiment, the convenience gaming system operation makes minimal use of the Internet, such that only information for which there is no security issues is transmitted via the Internet and/or information may be encrypted. Preferably, the communications network enables players to participate in gaming from remote locations (e.g., outside of the gaming area of a casino). Also, the system may enable players to be mobile during participation in the convenience gaming activities. Preferably, the system has a location verification or determination feature, which is operable to permit or disallow gaming from the remote location depending upon whether or not the location meets one or more criteria. The criterion may be, for example, whether the location is within a pre-defined area in which gaming is permitted by law.

Figure 1:
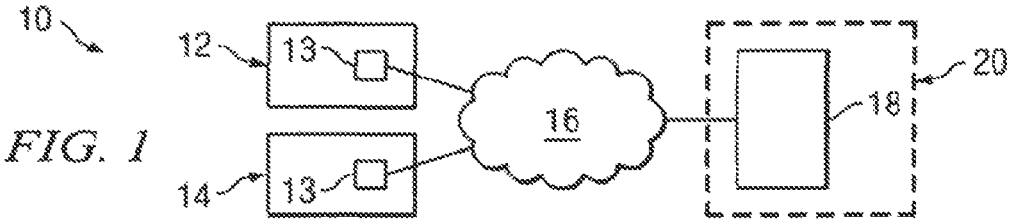
FIG. 1 illustrates a convenience gaming system according to an embodiment of the present invention.

As shown in FIG. 1, for example, convenience gaming system 10 includes at least one user 12. The system may include additional users such that there is at least a first user 12 and a second user 14. Multiple users may access a first convenience gaming system 10, while other multiple users access a second convenience gaming system (not shown) in communication with first gaming system 10. Users 12 and 14 preferably access system 10 by way of a gaming communication device 13. Gaming communication device 13 may comprise any suitable device for transmitting and receiving electronic communications. Examples of such devices include, without limitation, mobile phones, personal data assistants (PDAs), computers, mini-computers, etc. Gaming communication devices 13 transmit and receive gaming information to and from communications network 16. Gaming information is also transmitted between network 16 and a computer 18, such as a server, which may reside within the domain of a gaming service provider 20. The location of computer 18 is not critical, however, and computer 18 may reside adjacent to or remote from the domain of gaming service provider 20. Moreover, in certain embodiments, a gaming service provider is not required. The computer 18 and/or gaming service provider 20 may reside within, adjacent to, or remote from a gaming provider (not shown in FIG. 1). The gaming provider may be an actual controller of games, such as a casino. As an example, a gaming service provider may be located on the grounds of a casino and the computer 18 may be physically within the geographic boundaries of the gaming service provider. As discussed, however, other possibilities exist for remote location of the computer 18 and the gaming service provider 20. Computer 18 may function as a gaming server. Additional computers (not expressly shown) may function as database management computers and redundant servers, for example.

Preferably, software resides on both the gaming communication device 13 and the computer 18. Software resident on gaming communication device 13 is preferably operable to present information corresponding to gaming activities (including gambling and non-gambling activities discussed herein) to the user. The information includes, without limitation, graphical representations of objects associated with the activities, and presentation of options related to the activities and selectable by the user. The gaming communication device software is also preferably operable to receive data from the computer and data input by the user. Software resident on the computer is preferably able to exchange data with the gaming communication device, access additional computers and data storage devices, and perform all of the functions described herein as well as functions common to known electronic gaming systems.

Gaming information transmitted across network 16 may include any information, in any format, which is necessary or desirable in the operation of the gaming experience in which the user participates. The information may be transmitted in whole, or in combination, in any format including digital or analog, text or voice, and according to any known or future transport technologies, which may include, for example, wireline or wireless technologies. Wireless technologies may include, for example, licensed or license-exempt technologies. Some specific technologies which may be used include, without limitation, Code Division Multiple Access (CDMA), Global System for Mobile Communication (GSM), General Packet Radio Service (GPRS), WiFi (802.11x), WiMax (802.16x), Public Switched Telephone Network (PSTN), Digital Subscriber Line (DSL), Integrated Services Digital Network (ISDN), or cable modem technologies. These are examples only and one of ordinary skill will understand that other types of communication techniques are within the scope of the present invention. Further, it will be understood that additional components may be used in the communication of information between the users and the gaming server. Such additional components may include, without limitation, lines, trunks, antennas, switches, cables, transmitters, receivers, computers, routers, servers, fiber optical transmission equipment, repeaters, amplifiers, etc.

In at least one embodiment, the communication of gaming information takes place without involvement of the Internet. This has an advantage of avoiding the security problems which typically arise when conducting business over the Internet. However, in certain embodiments, a portion of the gaming information may be transmitted over the Internet. Also, some or all of the gaming information may be transmitted partially over an Internet communications path. In certain embodiments, some information is transmitted entirely or partially over the Internet, but the information is either not gaming information or is gaming information that does not need to be maintained secretly. For instance, data that causes a graphical representation of a table game on the user's gaming communication device might be transmitted at least partially over the Internet, while wagering information transmitted by the user might be transmitted entirely over a non-Internet communications network.

Figure 2:
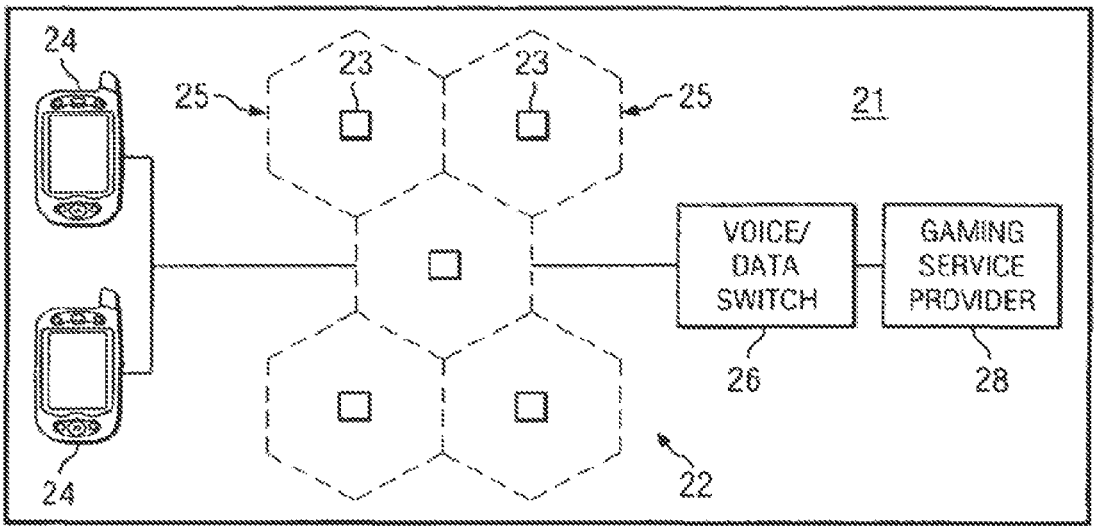
FIG. 2 illustrates a convenience gaming system with a wireless network according to an embodiment of the present invention.

According to one embodiment, as shown in FIG. 2 for example, the communications network comprises a cellular network 22. Cellular network 22 comprises a plurality of base stations 23, each of which has a corresponding coverage area 25. Base station technology is generally known and the base stations may be of any type found in a typical cellular network. The base stations may have coverage areas that overlap. Further, the coverage areas may be sectorized or non-sectorized. The network also includes mobile stations 24, which function as the gaming communication devices used by users to access the convenience gaming system and participate in the activities available on the convenience gaming system. Users are connected to the network of base stations via transmission and reception of radio signals. The communications network also includes at least one voice/data switch, which is preferably connected to the wireless portion of the network via a dedicated, secure landline. The communications network also includes a gaming service provider, which is likewise connected to the voice/data switch via a dedicated, secure landline. The voice/data switch may be connected to the wireless network of base stations via a mobile switching center (MSC), for example and the landline may be provided between the voice/data switch and the MSC.

Users access the convenience gaming system by way of mobile stations which are in communication with, and thus part of, the communications network. The mobile station may be any electronic communication device that is operable in connection with the network as described. For example, in this particular embodiment, the mobile station may comprise a cellular telephone.

Preferably, in the case of a cellular network for example, the convenience gaming system is enabled through the use of a private label carrier network. Each base station is programmed by the cellular carrier to send and receive private secure voice and/or data transmissions to and from mobile station handsets. The handsets are preferably preprogrammed with both gaming software and the carrier's authentication software. The base stations communicate via Private T-1 lines to a switch. A gaming service provider leases a private T-1 or T-3 line, which routes the calls back to gaming servers controlled by the gaming service provider. Encryption can be installed on the telephones if required by a gaming regulation authority, such as a gaming commission.

The cellular network is preferably a private, closed system. Mobile stations communicate with base stations and base stations are connected to a centralized switch located within a gaming jurisdiction. At the switch, voice calls are transported either locally or via long distance. Specific service provider gaming traffic is transported from the central switch to a gaming server at a host location, which can be a casino or other location.

As subscribers launch their specific gaming application, the handset will only talk to certain base stations with cells or sectors that have been engineered to be wholly within the gaming jurisdiction. For example, if a base station is close enough to pick up or send a signal across state lines, it will not be able to communicate with the device. When a customer uses the device for gaming, the system may prohibit, if desired, the making or receiving voice calls. Moreover, voice can be eliminated entirely if required. Further, the devices are preferably not allowed to "connect" to the Internet. This ensures a high level of certainty that bets/wagers originate and terminate within the boundaries of the gaming jurisdiction and the "private" wireless system cannot be circumvented or bypassed. Although in certain embodiments some data and/or voice traffic may be communicated at least partially over the Internet, it is preferred that the communication path does not include the Internet. Alternatively, in some embodiments, certain non-gaming information may be transported over a path which includes the Internet, while other information relating to the gaming activities of the system is transported on a path that does not include the Internet.

Figure 3:
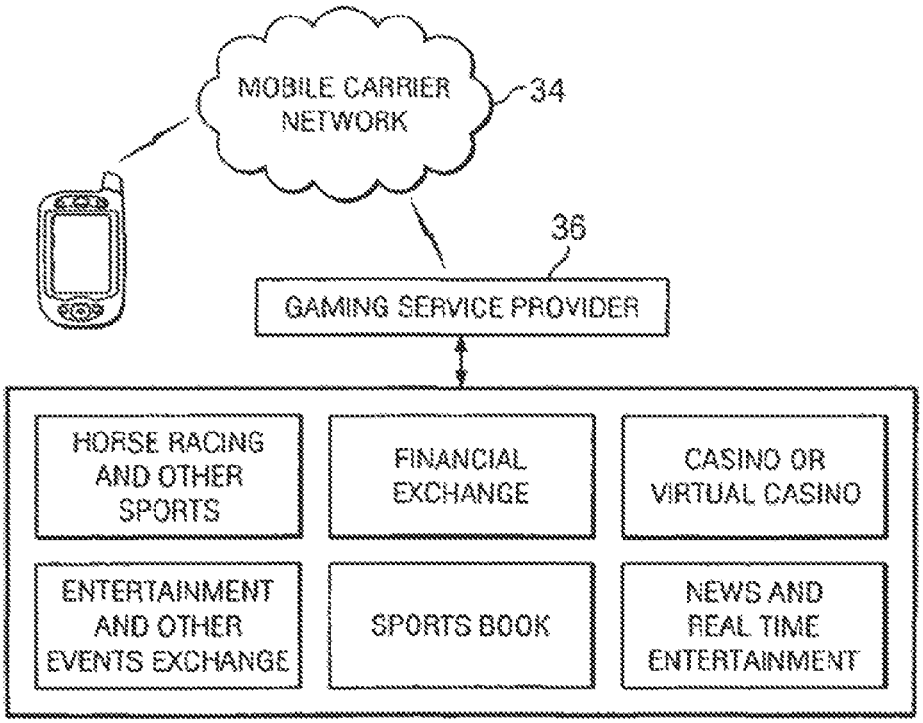
FIG. 3 is a block diagram of a convenience gaming system illustrating various gaming activities in accordance with an embodiment of the present invention.

As shown in FIG. 3, a gaming communication device 32 is in communication with a gaming service provider over a network 34. The gaming service provider preferably has one or more servers, on which are resident various gaming and other applications. As shown in FIG. 3, some example gaming applications include horse racing and other sports, financial exchange, casino and/or virtual casino, entertainment and other events exchange, and news and real time entertainment. Each of these applications may be embodied in one or more software modules. The applications may be combined in any possible combination. Additionally, it should be understood that these applications are not exhaustive and that other applications may exist to provide an environment to the user that is associated with any of the described or potential convenience activities.

Figure 4:
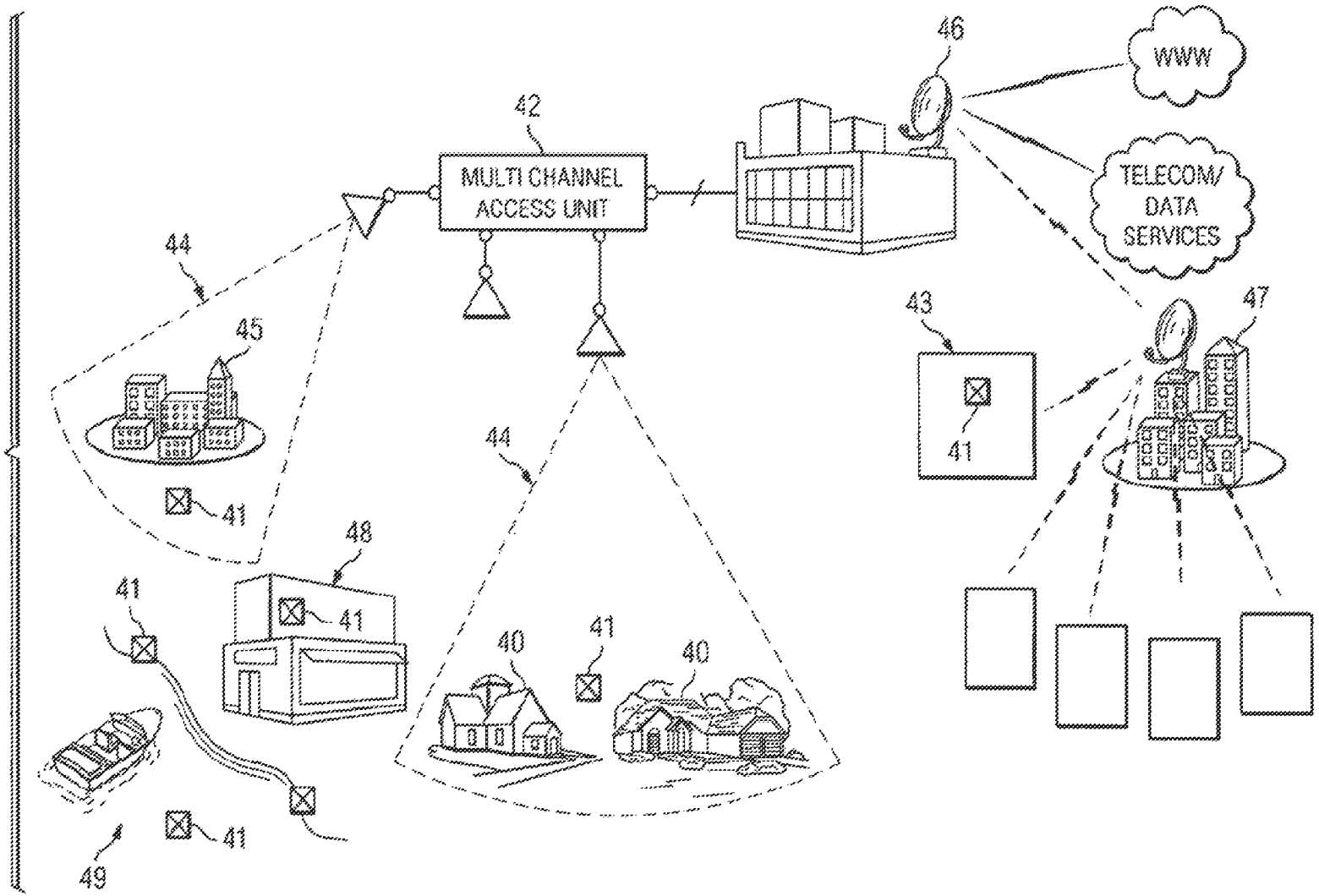
FIG. 4 illustrates a convenience gaming system showing coverage areas in accordance with an embodiment of the present invention.

In another embodiment, as shown in FIG. 4, for example, the communications network comprises a private wireless network. The private wireless network may include, for example, an 802.11x (WiFi) network technology to cover "Game Spots" or "Entertainment Spots." In FIG. 4, various WiFi networks are indicated as networks 41. Networks 41 may use other communications protocols to provide a private wireless network including, but not limited to, 802.16x (WiMax) technology. Further, networks 41 may be interconnected. Also, a convenience gaming system may comprise a combination of networks as depicted in FIG. 4. For example, there is shown a combination of private wireless networks 16, a cellular network comprising a multi-channel access unit or sectorized base station 42, and a satellite network comprising one or more satellites 46.

With respect to the private wireless network, because the preferable technology covers smaller areas, (e.g., in the range of 100-300 feet) and provides very high-speed throughput, the private wireless network is particularly well-suited for gaming commission needs of location and identity verification for the gaming service provider products. The gaming spots enabled by networks 41 may include a current casino area 48, new areas such as swimming pools, lakes or other recreational areas 49, guest rooms and restaurants such as might be found in casino 48 or hotels 45 and 47, residential areas 40, and other remote convenience gaming areas 43. The configuration of the overall convenience gaming system depicted in FIG. 4 is intended only as an example and may be modified within the scope of the present invention.

In one embodiment, the system architecture for the convenience gaming system includes:

(1) a wireless LAN (Local Access Network) component, which consists of mostly 802.11x (WiFi) and/or 802.16x WiMax technologies; robust security and authentication software; gaming software; mobile carrier approved handsets with Windows® or Symbian® operating systems integrated within; and (a) CDMA-technology that is secure for over-the-air data protection;

(b) at least two layers of user authentication, (that provided by the mobile carrier and that provided by the gaming service provider);

(c) compulsory tunneling (static routing) to gaming servers;

(d) end-to-end encryption at the application layer; and (e) state-of-the-art firewall and DMZ technologies;

(2) an MWAN (Metropolitan Wireless Access Network), which consists of licensed and license-exempt, point-to-point links, as well as licensed and license-exempt, point-to-multi-point technologies;

(3) private MAN (Metropolitan Access Network) T-1 and T-3 lines to provide connectivity where wireless services cannot reach; and (4) redundant private-line communications from the mobile switch back to the gaming server.

Each of the "Game Spots" or "Entertainment Spots" are preferably connected via the MWAN/MAN back to central and redundant game servers. For accessing the private wireless networks 41, the gaming communication devices are preferably WiFi- or WiMax-enabled PDAs or mini-laptops, and do not have to be managed by a third-party partner.

Preferably, the convenience gaming system includes a location verification feature, which is operable to permit or disable gaming from a remote location depending upon whether or not the location meets one or more criteria. The criterion may be, for example, whether the location is within a pre-defined area in which gaming is permitted by law. As another example, the criterion may be whether the location is in a no-gaming zone, such as a school. The location verification technology used in the system may include, without limitation, "network-based" and/or "satellite-based" technology. Network-based technology may included such technologies as multilateration, triangulation and geo-fencing, for example. Satellite-based technologies may include global positioning satellite (GPS) technology, for example.

As previously discussed, the cellular approach preferably includes the use of at least one cellular, mobile, voice and data network. For gaming in certain jurisdictions, such as Nevada for example, the technology may involve triangulation, global positioning satellite (GPS) technology, and/or geo-fencing to avoid the potential for bets or wagers to be made outside Nevada state lines. In one embodiment, the network would not cover all of a particular jurisdiction, such as Nevada. For instance, the network would not cover areas in which cellular coverage for a particular base station straddled the state line or other boundary of the jurisdiction. This is done in order to permit the use of location verification to insure against the chance of bets originating or terminating outside of the state. Triangulation may be used as a method for preventing gaming from unapproved locations. Triangulation may be accomplished, for example, by comparing the signal strength from a single mobile station received at multiple base stations, each having GPS coordinates. This technology may be used to pinpoint the location of a mobile station. The location can then be compared to a map or other resource to determine whether the user of the mobile station is in an unapproved area, such as a school. Alternatively, GPS technology may be used for these purposes.

Figure 5:
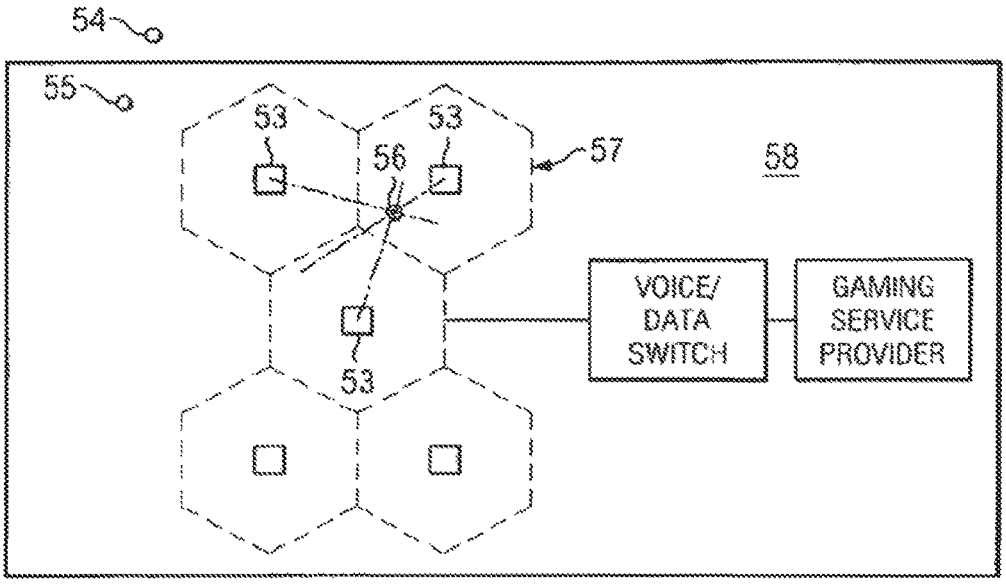
FIG. 5 illustrates a convenience gaming system with a wireless network showing triangulation location determination in accordance with an embodiment of the present invention.

As shown in FIG. 5, the convenience gaming system includes a plurality of gaming communication devices 54, 55, and 56. Device 54 is located outside the gaming jurisdiction 58. Devices 55 and 56 are both located inside gaming jurisdiction 58. However only device 56 is located within geo-fence 57, which is established by the coverage areas of a plurality of base station 53. Thus, geo-fencing may be used to enable gaming via device 56 but disable gaming via devices 54 and 55. Even though some gaming communication devices that are within the gaming jurisdiction 58, such as device 55, are not permitted access to the convenience gaming system, the geo-fence 57 ensures that no gaming communication devices outside jurisdiction 58, such as device 54, are permitted access.

Geo-fencing does not specify location. Rather, it ensures that a mobile station is within certain boundaries. For instance, geo-fencing may be used to ensure that a mobile station beyond state lines does not access the convenience gaming system. Triangulation on the other hand specifies a pinpoint, or near-pinpoint, location. For example, as shown in FIG. 5, device 56 is triangulated between three of the base stations 53 to determine the location of device 56. Triangulation may be used to identify whether a device, such as a mobile station, is located in a specific spot where gambling is unauthorized (such as, for example, a school). Preferably, the location determination technology utilized in conjunction with the present invention meets the Federal Communication Commission's (FCC's) Phase 2 E911 requirements. Geological Institute Survey (GIS) mapping may also be utilized to compare identified coordinates of a gaming communication device with GIS map features or elements to determine whether a device is in an area not authorized for gaming. It should be noted that any type of location verification may be used such as triangulation, geo-fencing, global positioning satellite (GPS) technology, or any other type of location determining technology, which can be used to ensure, or provide an acceptable level of confidence, that the user is within an approved gaming area.

In another embodiment, location verification is accomplished using channel address checking or location verification using some other identifying number or piece of information indicative of which network or portion of a network is being accessed by the gaming communication device. Assuming the using of an identifying number for this purpose, then according to one method of location checking, as an example, a participant accesses the gaming system via a mobile telephone. The identifying number of the mobile telephone, or of the network component being accessed by the mobile telephone, identifies the caller's connection to the mobile network. The number is indicative of the fact that the caller is in a defined area and is on a certain mobile network. A server application may be resident on the mobile telephone to communicate this information via the network to the gaming service provider. In a related embodiment, the identifying number or information is passed from a first network provider to a second network provider. For example, a caller's home network may be that provided by the second provider, but the caller is roaming on a network (and in a jurisdiction) provided by the first provider. The first provider passes the identifying information through to the second provider to enable the second provider to determine whether the caller is in a defined area that does or does not allow the relevant gaming activity. Preferably the gaming service provider either maintains, or has access to, a database that maps the various possible worldwide mobile network identifying numbers to geographic areas. The invention contemplates using any number or proxy that indicates a network, portion of a network, or network component, which is being connected with a mobile telephone. The identifying number may indicate one or more of a base station or group of base stations, a line, a channel, a trunk, a switch, a router, a repeater, etc.

In another embodiment, when the user connects his mobile telephone to the gaming server, the gaming server draws the network identifying information and communicates that information to the gaming service provider. The software resident on the gaming communication device may incorporate functionality that will, upon login or access by the user, determine the user's location (based at least in part on the identifying information) and send a message to the gaming service provider. The identifying number or information used to determine location may be country-specific, state-specific, town-specific, or specific to some other definable boundaries.

In connection with any of the location determination methods, the gaming system may periodically update the location determination information. This may be done, for example, during a gaming session, at pre-defined time intervals to ensure that movement of the gaming communication device to an unauthorized area is detected during play, and not just upon login or initial access.

Thus, depending on the location determination technology being used, the decision whether to permit or prohibit a gaming activity may be made at the gaming communication device, at the gaming server, or at any of the components of the telecommunication network being used to transmit information between the gaming communication device and the gaming server (such as at a base station, for example).

An aspect of the private wireless network related to preventing gaming in unauthorized areas is the placement of sensors, such as Radio Frequency Identification (RFID) sensors on the gaming communication devices. The sensors trigger alarms if users take the devices outside the approved gaming areas. Further, the devices may be "tethered" to immovable objects. Users might simply log in to such devices using their ID and password.

In connection with FIG. 6, an example embodiment of a method according to the present invention can be described as follows. As discussed, software is preferably loaded on a gaming communication device and is operable to receive input data for gaming. The input data may originate at associated gaming software resident on the gaming server, or it may be input by the user of the gaming communication device. The software on the device is operable to present a representation of a gaming environment. This can include, among other things, a representation of a table game such as a blackjack table or a slot machine. Other examples of the representation of a gaming environment include graphical representations of any of the other applications described herein.

Figure 6:
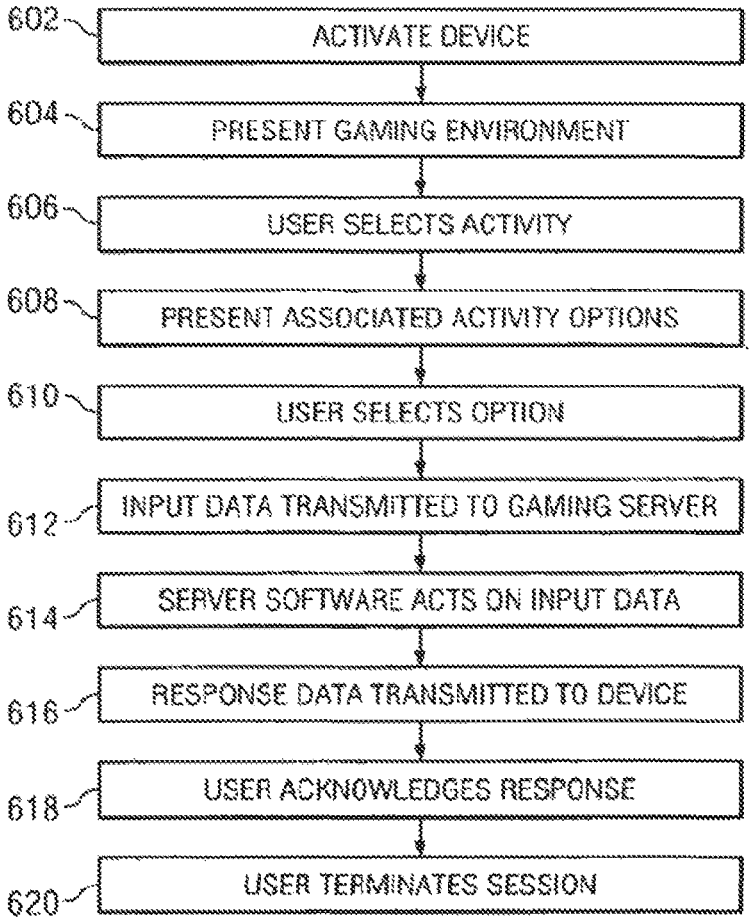
FIG. 6 is a flow chart depicting steps in a convenience gaming method according to an embodiment of the present invention.

In the example method shown in FIG. 6, in a first step 602, the gaming communication device is activated. This may take place as a function of turning on a phone, PDA, or other communication device as described elsewhere herein. Preferably, activation comprises connecting the gaming communication device to a private data network. Part of the activation includes logging in at a prompt. This may be considered as a first level of authentication of a user of the gaming communication device. A second level of user authentication comprises authentication of the gaming communication device itself. This may occur, for example, by authentication of a mobile station by a mobile carrier. A third level of user identification may comprise biometrics. Various examples of biometrics may include, but are not limited to, fingerprint identification, photo identification, retina scanning, voice print matching, etc.

In a next step 604, the user is presented with the gaming environment. The gaming environment may be presented in various stages. For instance, in a first stage, the gaming environment may comprise a casino lobby where the user is presented with certain gaming options including, for example, table games, slots, sports book, video poker, and a casino cashier. In a subsequent stage, the user may be presented with optional instances of the type of activity selected from the casino lobby.

In a next step 606, the user selects an activity, such as a particular casino table game. In step 608, the user is presented with one or more options related to the selected activity. In step 610, the user selects an option. For instance, at this point, the user might place a wager, draw a card, select a restaurant or restaurant menu item, select a news source or a news story, place a buy or sell order on a financial exchange, place a bet on a certain box office performance over/under amount for a given movie, etc. The options for user input are myriad. In step 612, the software resident on the gaming communication device accepts the option input by the user and transmits the input data to the software resident at the gaming server. In step 614, the gaming server software acts on the input data.

Actions in this point, may include, without limitation, determining an outcome and/or amount, accessing another server and/or software application, retrieving information, preparing a response to the user, etc. The action of determining an outcome and/or amount might take place, for example, if the user is using the device to place wagers in connection with a gambling activity. For certain gambling activities, such as a table game or slot machine, a random number generator may be incorporated to determine the outcome (i.e., whether the user won or lost) and the gaming server software would also determine an amount won or lost based on the amount wagered and any applicable odds. The action of accessing another server and/or software application might occur, for example, in the event the user is engaging in a services activity such as accessing news services, making reservations and placing food and beverage orders at a restaurant, or making a retail purchase. The action of retrieving information might occur when the gaming server software is prompted to access another server for the purpose of retrieving a certain type of information requested by the user.

Preferably, the gaming server software prepares a response to the user's input data and in step 616. In step 618, the user acknowledges the response. For example, in the case of gambling, the user might acknowledge that he won a hand of blackjack because the dealer busted and that his payout was $100 based on a $50 bet at even odds. In step 620, the user logs out.

In the situation where the user is gambling, after the series of steps described in connection with FIG. 6, (or a subset or modified series of steps), the user physically enters a casino and goes to a casino cashier for payout and/or settlement (which can include, for example, extensions of credit or advance deposits). In one embodiment, there is a waiting period (e.g., twenty-four hours) before the user can collect winnings. The purpose of the waiting period is to allow time for fraud monitoring. The waiting period may depend on the amount of the balance. For example, if the user is owed less than $5,000 the waiting period may be twelve hours. If the user is owed between $5,000 and $10,000 the waiting period may be twenty-four hours. If the user is owed more than $10,000 the waiting period may be forty-eight hours.

Figure 7:
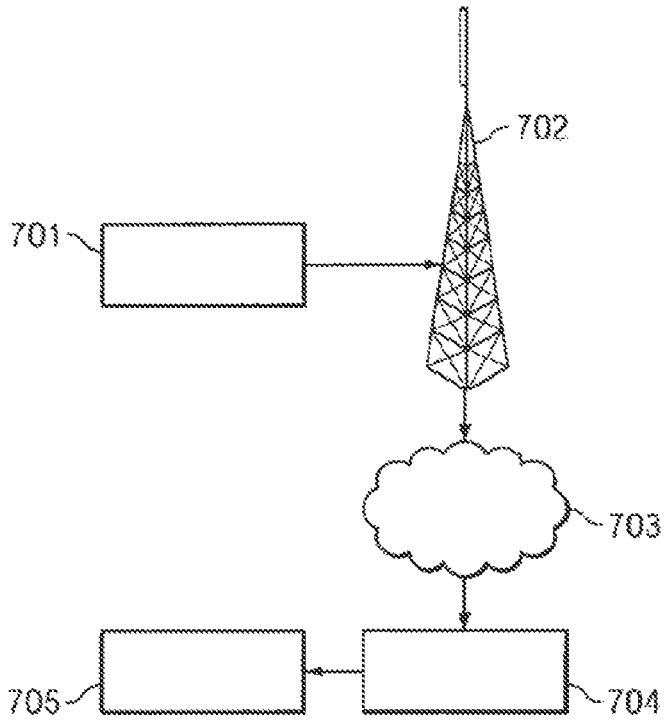
FIG. 7 depicts a convenience gaming system showing a communication path in accordance with an embodiment of the present invention.

Preferably, data is transmitted back and forth during the convenience gaming activities between the gaming communication device and a server controlled by the gaming service provider. An example of the path of communication is shown in FIG. 7. Gaming data, such as a wager placed by the user, is transmitted from gaming communication device 701 to a base station 702 (or a transmitter in the case of a private wireless network such as a WiFi or WiMax network). Base station 702 routes the data through network 703 to a hub or gateway 704, which in turn routes the data to a gaming server 705 operated by a gaming service provider. Preferably, the communication from gaming communication device 701 to the network 703 comprises wireless communication. This may be any type of known wireless communication or any type of wireless communication available in the future. Examples of acceptable wireless communication protocols include CDMA, GSM, and GPRS.

Preferably, the communication from the network 703 to the gateway 704 and to the server 705 are conducted over secure land lines. FIG. 7 is an example communication network only and the present invention should be understood to cover other networks in which data may be transmitted from gaming communication device 701 to server 705. Preferably, data in response to data being transmitted from gaming communication device 701 to server 705 is transmitted back to gaming communication device 701 along a path essentially opposite to the path of the first transmission. It should be noted that in at least certain embodiments of the methods and systems described herein, a user is not actually playing a game on the gaming communication device. Rather, the user is actually playing the game on the server controlled by the gaming service provider, which may be located within a casino.

With respect to payment and/or receipt of winnings and losses, one possible approach is as follows. Upon check-in at a casino hotel, a hotel representative may query a guest as to whether the guest wants access to a convenience gaming device. If the guest does want such access, the hotel representative may provide the guest with a gaming communication device in exchange for a credit-card type deposit or other deposit. The guest then deposits money into an account for wireless gaming The guest's account balance information is loaded onto the guest's account file, which is preferably maintained on the gaming server. The user may load money into his gaming account by establishing a credit account, for example, at a casino cashier and/or by paying cash to the casino cashier. Many other alternatives exist and this process is an example only. Guest accounts or gaming communication devices may be preloaded with funds. Funds may be deposited during a convenience gaming session. This may occur, for example, if a user selected a casino cashier activity from the gaming environment and instructed the cashier to add funds to the account. The finance subsystem may also utilize account card technology (such as ATM cards, credit cards, stored value cards, gift cards, etc) in order to conduct financial transactions associated with a user's account. Moreover, the user may receive or make payments remotely, by way of inputting instructions via the gaming communication device or by another remote device such as an automatic teller machine (ATM), which is in electronic communication with the gaming server or other server operated by the casino, hotel, gaming service provider or other entity involved in the convenience gaming activities. For example, a user might remotely (via the gaming communication device) place an order at a restaurant. Then, the user might make advance payment for the meal at an ATM-type machine which is operable to receive instructions corresponding to the financial transaction requirements of the convenience gaming activity of ordering food.

A unique aspect of the present invention includes establishing an electronic record of the gaming transactions undertaken by a user. Preferably, this is accomplished by utilization of a keystroke log, which is an electronic record of all keystrokes made by the user. Utilization of a keystroke log in this context allows for unprecedented monitoring of a user's gaming activity. In the event of a dispute, one may refer to the keystroke log and readily determine whether, in fact, a user placed a particular wager, for example.

An additional possible aspect of the electronic record is to allow a gaming control board or other regulatory authority, access to the electronic record in a direct manner in order to conduct periodic independent monitoring of the convenience gaming activities conducted over the system. Another possible aspect is to allow policing against rigged machines. For instance, it is possible that the gaming control board (or other regulatory authority) could obtain a gaming communication device and compare their test results over time against records in the electronic record database (e.g., by comparing the results shown in the keystroke log). This essentially comprises electronic access for testing.

Figure 8:
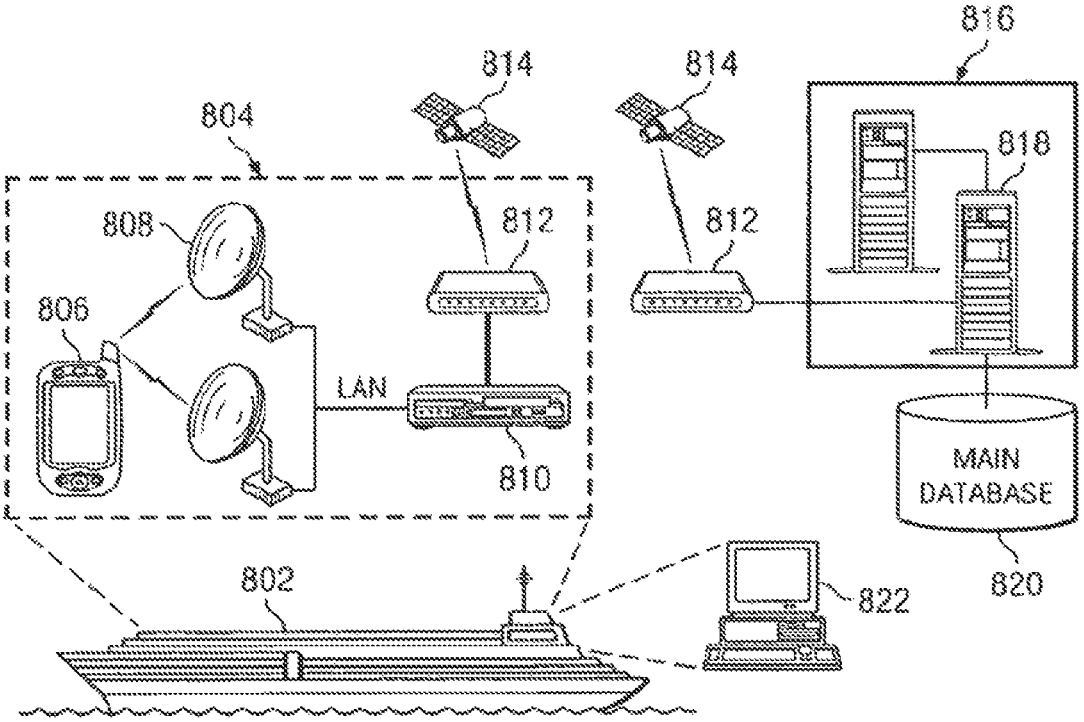
FIG. 8 illustrates a ship-based convenience gaming system in accordance with an embodiment of the present invention.

In another embodiment of the invention, as shown in FIG. 8, a ship-based convenience gaming system is provided. The system preferably comprises passenger vessel 802, such as a cruise liner for example. The system includes one or more gaming communication devices 806 connected to a communication network. The network shown in FIG. 8 comprises a mobile network with base stations 808 connected via a LAN to a base station controller (BSC) 810. BSC 810 is connected via a T1 interface to a first Very Small Aperture Terminal (VSAT) modem 812, which is in communication with a first satellite 814. First satellite 814 is operable to transmit and receive signals from second satellite 814, which is in communication with second VSAT modem 812. Second VSAT modem 812 is in communication with a gaming server 818 located at gaming service provider 816. Gaming server is coupled to gaming database 820. Again, the network configuration depicted in FIG. 8 is for example purposes only, and other configurations are within the scope of the present invention. An on-board back office 822 is preferably provided. Data is communicated by the on-board VSAT modem and transmitter to the first satellite for relay to the second (preferably land-based) VSAT receiver and modem. The data is then communicated to a server and/or centralized database via a mobile station controller (not shown).

A corresponding business model involves the gaming service provider contracting with a cruise line, which agrees to allow the gaming service provider to provide coverage throughout the cruise line's ship(s), by using repeaters for example. The gaming service provider may provide a private wireless network, in which case any revenue generated from use of or access to the private wireless network, and revenue from gaming activities, may be allocated among all or any subset of the cruise line and the gaming service provider. Alternatively, the gaming service provider may contract with a mobile carrier and a satellite provider, in which case revenue from the mobile calls, and revenue from gaming activities, may be allocated among all or any subset of the cruise line, the mobile carrier and the gaming service provider.

There are several scenarios for a user's activity relative to transactions conducted over the convenience gaming system. In one example scenario the user is in a fixed, but remote, location from the gaming server, which may be located on the premises of a casino. This may be include, for instance, a situation in which the gaming communication device is a kiosk or some other communication device which is in a fixed position or which is tethered to a fixed position so that the gaming communication device cannot be moved beyond a certain area. In another example scenario, the user starts a convenience gaming transaction at a first location and ends the transaction at a second location different from the first location. In another example scenario, the user is mobile during a single convenience gaming transaction. In another example scenario, the user is mobile within a first approved area then (during the convenience gaming transaction) the user moves outside the first approved area, through an unapproved area, to a remote second approved area.

In another example embodiment, the convenience gaming system may be used to enable gaming activities involving multiple wireless users who interact with one another. For instance, the system may enable a table game (such as blackjack) in which a first user and a second user are conducting gaming transactions on the same table and in which options selected by the first user directly impact outcomes and options relative to the second user. Preferably, the gaming environment presented on the gaming communication devices of both the first and second users will indicate the existence and activity of the other respective user. Another example of multiple users interacting on the convenience gaming system is the provision of a poker game in which users place bets against one another instead of, or in addition to, placing bets against the house. Another example of interaction between users is when a first user makes restaurant reservations or purchases event tickets, thereby reducing the options available to the second user.

Preferably, the gaming service provider provides at least the following functions. First the gaming service provider provides and controls the one or more gaming servers. These servers may be physically located within the confines of the gaming service provider or may exist at a remote location. As mentioned, the gaming servers may also be located at or near a games provider such as a casino, casino hotel, racino, cruise ship, race track, etc. The gaming service provider may also provide monitoring services such as transaction monitoring and key stroke logging services. The gaming service provider may also provide data management and security services. These services are not intended to be exhaustive and the gaming service provider may provide other services which facilitate the convenience gaming process.

It should be noted that the invention can be implemented in connection with any gaming environment or an environment for any other activity, which may be conducted electronically. The invention is not limited to Nevada or any other particular gaming jurisdiction. For instance, the invention can be employed in connection with casinos in Atlantic City, New Jersey, international jurisdictions, Native American gaming facilities, and "racinos" which are race tracks that also have slot machines, video lottery terminals, or other gambling devices. For example, in connection with "racinos," the invention might be used by participants who wish to play slot machine games while they are viewing race horses in the paddock area. This might be desirable in the event that the slot machine area does not allow smoking and a participant wishes to gamble from an outdoor smoking area. Alternatively, the slot machine area might permit smoking and the gambler wishes to play the slot machines from an area where he or she can avoid breathing second-hand smoke. Numerous other scenarios can be envisioned in which the gaming participant can use the invention to participate in remote gaming, while enjoying some other primary activity in a location remote from the gaming facility. Further, the invention is not limited to gaming, but can include other applications, such as trading financial instruments, and wagering on other types of events, such as elections, award events, or any other activity.

In at least one embodiment, the invention provides jurisdictional controls, which limit gaming to approved geographical areas. The invention may also include an age/identity verification feature. This can be accomplished through any applicable technique including retina scanning, finger print identification, voice print matching, or other biometrics. Identity verification can also be accomplished by having a customer take a picture of himself (e.g., by use of a digital picture phone) and transmitting the picture to the gaming service provider for comparison to a stored picture of the pre-approved user. Identity verification can also be accomplished by way of comparison of participant provided data to stored data, and execution of electronic agreements or contracts by the participant. The invention may also provide for the logging of keystrokes. In at least one embodiment, all communications are accomplished without accessing the Internet.

Mobile, remote gaming may be desirable for many reasons, some of which have already been described. The invention may allow supplementation of existing in-house gaming revenue by allowing bettors to place bets while enjoying other leisure activities such as golf, swimming, dining and shows. The invention may complement the new coinless wagering environment as bettors can play their favorite games outside the casino. The invention provides a high-speed, reliable, accurate, and secure mobile gaming environment that complies with regulatory requirements for identification and location verification of the bettor with the ability to generate key stroke logs. The invention may restrict unauthorized usage from a geographic perspective and is capable of implementation using location verification technology (e.g., geo-fencing) to conform the gaming activities to legal parameters.

Consumers may benefit from an increased choice of gaming environments. Consumers will be able to bet in whatever surroundings they prefer, benefiting from the knowledge that the product is regulated, fair and secure while enjoying the gaming experience at the speed they choose without external influences, such as that which might occur within the in-house casino environment. The gaming businesses can use the invention to increase their revenue base through a new, regulated, mobile, remote channel. Customers wanting to be entertained during downtime or outside a casino will be able to play games on their gaming communication device and customers intimidated by a traditional casino environment will be able to play in private. The gaming jurisdictions may benefit from an increase in gaming an ancillary revenue growth because customers will have a more enjoyable experience.

The invention may also be used to deliver content at an increased speed compared to traditional telecommunications systems. The content may include, for example, live reports, entertainment, news, promotions and advertising.

As mentioned, the invention provides a mobile gaming environment that complies with regulatory requirements for identification and location verification of the bettor. Moreover, the system is designed to be one hundred percent "clean" from a regulatory perspective. The software is clean in that it has not been and will not be licensed to anyone who does business illegally or otherwise operates in a "gray" area. For example, in a preferred embodiment, the software is not licensed to an entity that will illegally operate the software, or otherwise illegally do business on, the Internet. This may be desirable in that certain gaming jurisdictions will not grant gaming permits or licenses to companies that do business with, or license technology to or from, other entities known to be engaging in illegal operations.

Preferably, the system is designed such that the gaming software (or other application software operating on the system) is also one hundred percent clean from a regulatory perspective. For instance, before granting a license, a gaming jurisdiction may require that the software being used is not tainted in that it has not been used by the license applicant in violation of any laws and has not been licensed or otherwise distributed or disseminated to others who have used the software for illegal purposes, or who have been engaging in illegal activity. Therefore, it is preferred that the gaming software be clean and untainted from this perspective.

The systems and methods described herein may also be used to deliver and/or access "Rich Media" content such as, for example, sports video (live or nearly live) and audio commentary. Such may often only be distributed within specific jurisdictions. Therefore, the distribution may benefit from the inventive aspects discussed herein, particularly the location verification aspect, such as geofencing.

The gaming system and methods described herein may permit, among other things, pari-mutuel wagering, sports betting, and dissemination of news and other content. The invention also enables a casino or other gaming provider to advertise ancillary services such as shows, bars, and restaurants. The invention also enables remote reservations and purchases in connection with such services.

According to an embodiment of the invention, the convenience gaming system provides for the dissemination of real-time odds to users accessing the system.

In another embodiment, an outcome in one transaction can trigger the presentation to the user of options for a second transaction. For example, if a user wins a predetermined amount of money playing blackjack, the user might be presented with an option to purchase retail items at a casino store or to make reservations for certain services at a club. As another example, if a user uses the system to purchase show tickets, the user might be offered to make reservations at one of several restaurants within a certain proximity to the show.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed is:

1. An apparatus, comprising:

at least one processor; and at least one memory device electronically coupled to the at least one processor, in which the at least one memory device stores instructions which, when executed by the at least one processor, direct the at least one processor to:

responsive to a user using a device to access a gaming system to start a gaming session:

determine that the device is within a geographic area in which the gaming session is permitted and beyond a predetermined distance from a border of the geographic area in which the gaming session is permitted;

allow, by at least one processor, the device to submit wagers on gaming activities based upon a determination that the device is within the geographic area and located beyond the predetermined distance from the border of the geographic area;

wherein to allow the user to wager further includes to present to the user via the device a gaming environment, wherein the gaming environment includes a plurality of gaming activities and a cashier option;

receive from the user via the device a selection of the cashier option and add funds to an account of the user based in part on the selection of the cashier option;

receive from the user via the device a selection of one of the plurality of gaming activities;

based in part on receiving the selection of one of the plurality of gaming activities, present to the user via the device with one or more options related to a selected gaming activity, wherein the one or more options include a wager option;

execute the selected gaming activity, wherein to execute the selected gaming activity, the instructions, when executed by the at least one processor, further direct the at least one processor to:

receive from the user via the device a selection of one or more options related to the selected gaming activity including a selection of the wager option, the selection of the wager option resulting in a wager on the selected gaming activity;

monitor keystrokes made by the user with respect to the selected gaming activity, and establish an electronic record of the monitored keystrokes, wherein the selection of one of the plurality of gaming activities and the selection of the wager option by the user are stored in the electronic record for a predetermined time period;

determine through use of a random number generator an outcome of the selected gaming activity;

when the outcome is a winning outcome, communicate to the user via the device an amount won; and during the gaming session determine whether the user should be allowed to continue the gaming session, wherein to determine whether the user should be allowed to continue the gaming session includes to:

determine an identifier that indicates a network, a portion of a network, or a network component the device is connected to in order to access the gaming system; and map via a database the identifier to a geographic area.

2. The apparatus of claim 1, wherein the device is a mobile phone, a PDA, or a computer.

3. The apparatus of claim 1, wherein the plurality of gaming activities include at least one wagering activity and at least one non-wagering activity.

4. The apparatus of claim 1, wherein the selected gaming activity is sports betting.

5. The apparatus of claim 1, wherein the instructions, when executed by the at least one processor, further direct the at least one processor to provide real time odds to the device .

6. The apparatus of claim 1, wherein the instructions, when executed by the at least one processor, further direct the at least one processor to provide sports video to the device.

7. A method comprising:

responsive to a user using a device to access a gaming system to start a gaming session:

determining that the device is within a geographic area in which the gaming session is permitted and beyond a predetermined distance from a border of the geographic area in which the gaming session is permitted;

allowing the device to submit wagers on gaming activities based upon a determination that the device is within the geographic area and located beyond the predetermined distance from the border of the geographic area;

wherein the allowing of the user to wager further includes presenting to the user via the device a gaming environment, wherein the gaming environment includes a plurality of gaming activities and a cashier option;

receiving from the user via the device a selection of the cashier option and adding funds to an account of the user based in part on the selection of the cashier option;

receiving from the user via the device a selection of one of the plurality of gaming activities;

based in part on receiving the selection of one of the plurality of gaming activities, presenting to the user via the device with one or more options related to a selected gaming activity, wherein the one or more options include a wager option;

executing the selected gaming activity, wherein the executing of the selected gaming activity further comprises:

receiving from the user via the device a selection of one or more options related to the selected gaming activity including a selection of the wager option, the selection of the wager option resulting in a wager on the selected gaming activity;

monitoring keystrokes made by the user with respect to the selected gaming activity, and establishing an electronic record of the monitored keystrokes, wherein the selection of one of the plurality of gaming activities and the selection of the wager option by the user are stored in the electronic record for a predetermined time period;

determining through use of a random number generator an outcome of the selected gaming activity;

when the outcome is a winning outcome, communicating to the user via the device an amount won; and during the gaming session determining whether the user should be allowed to continue the gaming session, wherein the determining of whether the user should be allowed to continue the gaming session includes:

determining an identifier that indicates a network, a portion of a network, or a network component the device is connected to in order to access the gaming system; and mapping via a database the identifier to a geographic area.

8. The apparatus of claim 1, wherein the instructions, when executed by the at least one processor, further direct the at least one processor to:

determine that the user has won a predetermined amount; and present to the user via the device an option to purchase an item or reserve a service as a result of winning the predetermined amount.

9. The method of claim 7, wherein the device is a mobile phone, a PDA, or a computer.

10. The method of claim 7, wherein the plurality of gaming activities include at least one wagering activity and at least one non-wagering activity.

11. The method of claim 7, wherein the gaming session comprises sports betting.

12. The method of claim 7, further comprising providing real time odds to the device .

13. The method of claim 7, further comprising providing sports video to the device.

14. The method of claim 7, further comprising:

determining that the user has won a predetermined amount; and presenting to the user via the device an option to purchase an item or reserve a service as a result of winning the predetermined amount.

* * * * *